US009650166B2

(12) United States Patent
Falise et al.

(10) Patent No.: US 9,650,166 B2
(45) Date of Patent: May 16, 2017

(54) TRANSPORTING DEVICE FOR PRESSED BALES

(75) Inventors: Dirk Falise, Kaufering (DE); Norbert Sauerwein, Augsburg (DE)

(73) Assignee: HI TECH TEXTILE HOLDING GMBH, Leonding (AT)

( * ) Notice: Subject to any disclaimer, the term of this patent is extended or adjusted under 35 U.S.C. 154(b) by 553 days.

(21) Appl. No.: 14/342,454

(22) PCT Filed: Sep. 3, 2012

(86) PCT No.: PCT/EP2012/067079

§ 371 (c)(1),
(2), (4) Date: Mar. 3, 2014

(87) PCT Pub. No.: WO2013/030401

PCT Pub. Date: Mar. 7, 2013

(65) Prior Publication Data

US 2014/0208694 A1 Jul. 31, 2014

(30) Foreign Application Priority Data

Sep. 2, 2011 (DE) ..... 20 2011 051 189 U
Oct. 12, 2011 (DE) ..... 20 2011 051 610 U
Dec. 7, 2011 (DE) ..... 20 2011 052 218 U

(51) Int. Cl.

| | |
|---|---|
| ***B65B 27/12*** | (2006.01) |
| ***B30B 9/30*** | (2006.01) |
| ***B65B 13/04*** | (2006.01) |
| ***B65B 11/10*** | (2006.01) |
| ***B65B 9/13*** | (2006.01) |

(52) U.S. Cl.

CPC ..... *B65B 27/12* (2013.01); *B30B 9/301* (2013.01); *B30B 9/3003* (2013.01); *B30B 9/3014* (2013.01); *B30B 9/3078* (2013.01); *B65B 9/135* (2013.01); *B65B 11/10* (2013.01); *B65B 13/04* (2013.01); *B65B 27/125* (2013.01)

(58) Field of Classification Search

CPC ..... B65B 27/12; B65B 9/135; B65B 11/10; B65B 13/04; B65B 27/125; B30B 9/3003; B30B 9/301; B30B 9/3014; B30B 9/3078

USPC ..... 100/3

See application file for complete search history.

(56) References Cited

U.S. PATENT DOCUMENTS 3,095,678 A 7/1963 Cliff et al.
3,228,166 A 1/1966 Thiele
(Continued)

FOREIGN PATENT DOCUMENTS

CN 201049741 Y 4/2008
DE 39 08 957 A1 9/1990
(Continued)

*Primary Examiner* — Robert Long
*Assistant Examiner* — Xavier A Madison
(74) *Attorney, Agent, or Firm* — McGlew and Tuttle, P.C.

(57) ABSTRACT

A packaging apparatus for compressed pressed bales (25) is designed to apply a bale packaging (32) to the pressed bale (25) and has a transporting device (5), which is designed to remove a compressed pressed bale (25) from a press (3, 3'). The transporting device (5) has a movable bale receptacle (6) for picking up the compressed pressed bale (25) on two opposite sides, wherein the bale receptacle has several elongated support elements (20) arranged at a distance from one another on each of the areas intended to retain the pressed bale.

20 Claims, 18 Drawing Sheets

(56) References Cited

U.S. PATENT DOCUMENTS

| | | | | |
|---|---|---|---|---|
| 3,541,948 | A * | 11/1970 | Sauer | B65B 13/20 100/215 |
| 3,673,950 | A * | 7/1972 | Koehler | B65B 13/20 100/100 |
| 4,158,994 | A | 6/1979 | Jensen | |
| 6,074,155 | A | 6/2000 | Hirschek | |
| 7,055,424 | B1 * | 6/2006 | Bielli | B30B 9/3078 100/138 |
| 2009/0229226 | A1 * | 9/2009 | Beeland | B65B 27/125 53/450 |
| 2011/0011036 | A1 | 1/2011 | Falise et al. | |

FOREIGN PATENT DOCUMENTS

| | | | |
|---|---|---|---|
| DE | 42 35 409 | C1 | 1/1994 |
| DE | 94 19 918 | U1 | 4/1996 |
| DE | 200 17 405 | U1 | 2/2002 |
| DE | 20 2008 003760 | U1 | 7/2009 |
| EP | 0 198 992 | A1 | 10/1986 |
| EP | 0 220 980 | B1 | 11/1989 |
| EP | 0 579 858 | A1 | 1/1994 |
| EP | 0 695 690 | A1 | 2/1996 |
| EP | 2 418 151 | A1 | 2/2012 |
| WO | 02/38364 | A1 | 5/2002 |

* cited by examiner

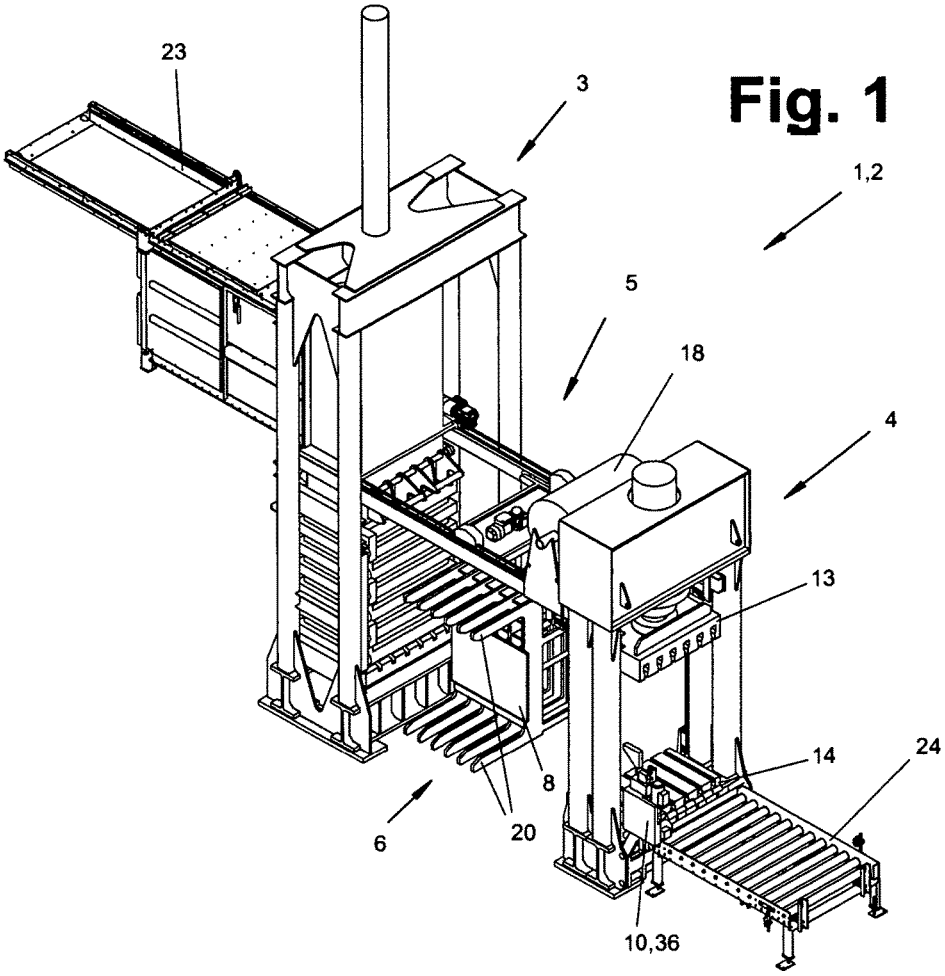
Fig. 1
Fig. 2
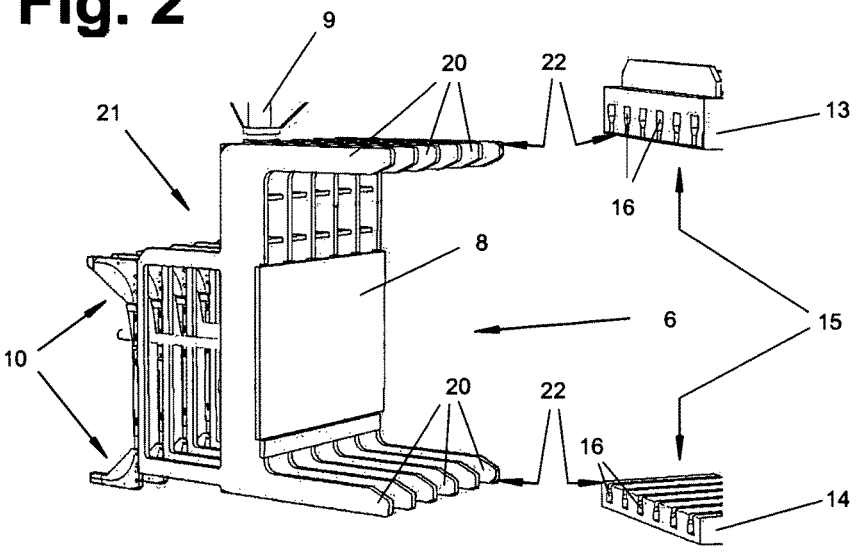

3
35
26
7
4
16
11
17
5,6
20

3
35
26
7
4
16
11
17
5,6
20

TRANSPORTING DEVICE FOR PRESSED BALES

CROSS REFERENCE TO RELATED APPLICATIONS

This application is a United States National Phase Application of International Application PCT/EP2012/067079 filed Sep. 3, 2012 and claims the benefit of priority under 35 U.S.C. §119 of DE 20 2011 051 189.8 filed Sep. 2, 2011 and DE 20 2011 051 610.5 filed Oct. 12, 2011 and DE 20 2011 052 218.0 filed Dec. 7, 2011, the entire contents of which are incorporated herein by reference.

FIELD OF THE INVENTION

The invention present invention pertains to a transporting device for pressed bales, to a packaging system for pressed bales as well as to a bale press plant having designed to apply a bale packaging on a compressed pressed bale.

BACKGROUND OF THE INVENTION

It is known in practice that highly compressed pressed bales can be produced in a baling press. Such baling presses usually have a prepress, in which material to be pressed is accumulated, optionally in a plurality of batches, and precompressed into a pressed bale. The pressed bale is subsequently subjected to final pressing into a highly compressed pressed bale in a finishing press under high pressing pressure. On the one hand, rotary presses are known in this connection, for example, according to EP 0 695 690 A1, in which the precompressed pressed bales are placed together with the pressure rams and the press box from the prepress into the finishing press with a rotary table. At the same time, an emptied press box is turned back from the finishing press to the prepress.

On the other hand, it is known from WO 02/38364 A1 that the press box of a prepress can be provided with a displaceable rear wall, a front wall that can be folded outwards and upwards by 90° as well as with a press box underside extended under the rear wall. With the front wall of the press box folded up, the underside of the press box with the displaceable rear wall can be displaced in the direction of a finishing press in a prepress of this type, and the folded-up front wall and the displaced lower wall come into contact with the upper and lower pressure rams of the finishing press and the precompressed pressed bale is pushed into the finishing press through the displaceable rear wall. The folded-up front wall and the displaceable underside of the press box form a channel here, in which the precompressed pressed bale can be displaced.

A packaging device for precompressed pressed bales is likewise known from WO 02/38364 A1. A film curtain can be hung between the end of the channel formed from the front wall of the press box and the underside of the press box and the pressure rams of the finishing press. When the precompressed press box is pushed into the finishing press, the film curtain is fixed at the lower end while more film material is fed from the upper end. The film forms a loop here, which is wound around the precompressed pressed bale during the inserting motion into the finishing press. The film is applied directly on the pressed bale. To prevent the film loop, which is pulled through between the pressure rams and the bale under pressure while the pressed bale is being pushed in, from tearing, only a low precompressing pressure is possible, on the one hand, and, on the other hand, a comparatively thick film material with high load-bearing capacity and a thickness of 100 μm or more is necessary.

SUMMARY OF THE INVENTION

The object of the present invention is to provide an improved transporting technique and possibly an improved packaging technology for pressed bales as well as an improved bale press plant.

The present invention accomplishes this object with a transporting device, for pressed bales which has a bale receptacle for retaining a pressed bale on at least two opposite sides of the bale. With the bale receptacle, which is designed, e.g., as a supporting fork, the transporting device can remove a pressed bale from a press and hold it in its pressed form and feed it for further processing, e.g., fixing and/or packaging or wrapping. These treatment operations can be uncoupled from the pressing process producing the bale and from the corresponding press, especially in time and space. This can, on the one hand, relieve the burden on the press and pressing process and make it possible to increase the capacity of the press and pressing process. On the other hand, such treatment operations can be carried out better and more flexibly externally. An adapted fixing and/or packaging system may also be provided now. The transporting technique being claimed, optionally together with the fixing and/or packaging system(s), also improves the performance capacity, economy and flexibility of a bale press plant with one or more presses.

The pressed bale may consist of any desired material, preferably fiber material. These may be, e.g., synthetic fibers, especially fibers consisting of acetate, polyester, etc., or natural fibers, especially cotton fibers. The fibers may be in the form of long strands, as so-called tow, or in the cut short form, as so-called staple fibers. Other bale materials, e.g., material remnants, straw, etc., are possible as well. The bale materials, especially fiber materials, may possess different properties, e.g., in terms of their elastic and settling characteristics during pressing. They may also impose different requirements on the pressing and treatment technique, e.g., in terms of purity, hygiene, the need for protection against environmental effects, etc. The bale materials are compressed with very high pressing forces, which may reach 1,000 kN and substantially higher values, e.g., 5,000 kN and higher, for producing highly compressed pressed bales, especially fiber pressed bales. The pressed bales may possibly develop correspondingly strong restoring forces.

The transporting technique being claimed, optionally together with the fixing and/or packaging system(s), and the bale pressing technique can, on the whole, meet all these conditions and requirements especially well and can be optimally adapted.

An additional press may act as a supporting means to remove the pressed bale being held in the compressed form from the bale receptacle. It can compress and reduce the size of the pressed bale to the extent that it can be easily separated from the bale receptacle. It can possibly also take over the pressed bale and possibly subject it more significantly to further compression, e.g., to final pressing. The treatment of the pressed bale with one or more treatment steps, e.g., fixing and/or packaging or wrapping, may take place at the bale receptacle and/or at the additional press and/or at a possibly additional station or means arranged downstream.

The above-mentioned bale sides are preferably the pressure sides, especially the upper side and the underside, of the pressed bale. The bale receptacle has a plurality of elongated, e.g., parallel rod-shaped or beam-shaped support elements located at spaced locations from one another on the sides intended for retaining the pressed bale. The support elements are designed to pick up the pressed bale, which is under pressure, at the press, while the pressed bale is being held between the support elements due to its elastic internal stress.

The support elements may be preferably arranged in a regular pattern in the manner of fork tines. The arrangement of the support elements may correspond to recesses in the active surface of the pressure rams of a press, e.g., of a prepress or of a finishing press. It is made possible as a result that the bale receptacle can be inserted when the press box is opened laterally such that the support elements are inserted into the recesses such that they extend around the compressed pressed bale. When the load on the pressed bale is relieved, for example, by lifting the upper pressure ram, the compressed pressed bale can slightly relax elastically, expand in the process, and it will thus come into contact with the support elements of the bale receptacle. The pressed bale is now held between the support elements because of its elastic stress, without a feed motion of the support elements towards the sides of the pressed bale being necessary. The bale receptacle can thus be designed as a passive receptacle. As a result, no movable parts or parts that are to be driven are necessary in the contact area between the bale receptacle and the precompressed pressed bale, which makes possible an especially cost-effective and simple construction of the transporting device. In particular, the support elements may be arranged rigidly on a basic carrier of the bale receptacle. No lubrication points are necessary in the contact area, so that the risk of contamination of the pressed bales is minimized.

The transporting device preferably has a moving device, for example, a multiaxial manipulator. The manipulator may have any desired design. It may have, for example, a plurality of cross slides movable essentially at right angles in relation to one another with traveling mechanisms. As an alternative, the manipulator may be a multiaxial industrial robot.

The bale receptacle can be moved with the manipulator between one or more presses, e.g., prepresses, and one or more other presses, e.g., finishing presses, of a bale press plant. As an alternative or in addition, a bale receptacle may be able to be moved with the manipulator to a packaging station.

The operation for producing a precompressed pressed bale in the prepress may usually take considerably longer than a final pressing operation. To achieve the shortest possible press cycle and high output efficiency of the bale press plant, it may therefore be advantageous, for example, to combine two or more prepresses each with one finishing press. The number of prepresses and finishing presses may be optimized here for the corresponding cycle times of the prepresses and finishing presses. It is likewise possible to provide a number of packaging systems and/or packaging stations suitable for optimization of the cycle. The number of components of the plant may also be determined by other optimization criteria.

Depending on the design of the manipulator, a bale receptacle of the transporting device may serve alternatingly a plurality of prepresses and/or finishing presses and/or packaging systems and/or packaging stations and alternating transport, for example, a prepressed pressed bale from a first prepress and then from a second prepress to a finishing press. An especially efficient bale press plant is advantageously made possible hereby. Such a bale press plant can also continue to be operated in case of failure of only one prepress without the operation of the other prepresses and/or finishing presses being compromised hereby and vice versa. The transporting device thus contributes to an increase in the availability of the plant.

A packaging system being claimed is designed to apply a suitable bale packaging or bale wrapping, e.g., a film packaging, on a precompressed or finally compressed pressed bale. It has, e.g., means for forming a stretched film web, especially a film curtain. The packaging system preferably comprises a transporting device with a movable bale receptacle of the above-described kind or cooperates with such a bale receptacle. As an alternative, the packaging system may have another transporting device with a movable bale receptacle for receiving a precompressed pressed bale. In particular, the bale receptacle may preferably have the aforementioned elongated support elements.

The bale receptacle with a pressed bale being held therein can be preferably moved through the stretched film web by the packaging system, while the film web forms a loop around the bale receptacle and the pressed bale being held therein. The loop may surround the bale receptacle preferably on three sides, and the formation of the loop may preferably take place such that a lower end of the stretched film web is being held while an upper end can be fed, or vice versa. When the bale receptacle is being passed through the stretched film web, film material can thus be fed from the top and it can envelope the bale receptacle as well as the pressed bale while forming a loop.

Such an application of the film to the bale receptacle and the pressed bale is especially gentle for the pressed bales and the film material being used. It is achieved hereby that an especially thin and preferably suitable film can be used. For example, a film with a thickness of 30 μm to 100 μm and preferably 50 μm to 70 μm can thus be used.

The packaging system may be arranged at the feed opening of a finishing press. When the bale receptacle is passed through the film tube, the pressed bale being held in the bale receptacle can be inserted at the same time into the finishing press and especially into the free space between an upper pressure ram and a lower pressure ram. The film loop formed in the process can preferably slide freely now on the upper side and the underside between the outer areas of the bale receptacle and the active surfaces of the pressure rams. The film material is not clamped as a result between the pressed bale and the pressure rams or between the bale receptacle and the pressure rams during the formation of the loop and is thus subject to a low tensile and shearing load only.

The pressure rams of the additional press, especially finishing press, may likewise have recesses in the active surfaces, to which recesses the support elements of the bale receptacle can correspond. A pressing pressure can be applied in this manner by placing the pressure rams on the pressed bales being held in the bale receptacle, and the pressure ram with its active surface can always pass through between the support elements of the bale receptacle. Depending on the width of the pressing motion and the pressing pressure applied in the process, the pressed bale can be compressed in the finishing press with the bale receptacle, which is present there at the same time, to the extent that the elastic holding force between the pressed bale and the support elements is reduced or eliminated altogether. The pressed bale can thus be released again between the support elements. The bale receptacle can then be removed again from the finishing press, while the precompressed pressed bale remains in the finishing press. Such a takeover of the pressed bale from the bale receptacle into the finishing press can take place with and without a film loop applied.

The pressed bale can be assisted in remaining in the finishing press preferably by a push-out device. Such a push-out device may be preferably arranged at the bale receptacle and can be moved out of the finishing press in the opposite direction during the outward motion of the bale receptacle, so that the push-out device holds the pressed bale supportingly in position within the finishing press. The bale receptacle can also be removed in this manner when there still is a residual pressing pressure between the pressed bale and the support elements, and shearing open of the pressed bale or another undesired deformation is avoided.

Moving of the bale receptacle with the pressed bale into the finishing press and pulling out of the bale receptacle are also possible, in particular, if a film loop was placed around the bale receptacle and the pressed bale by the packaging system. When the pressure rams are applied to the pressed bale, the film located between the bale receptacle and the pressure rams can preferably also be pulled into the recesses in the active surface of the pressure rams. The film is now preferably in contact in some sections on the side either with the outer surfaces of the support elements or with the areas of the active surfaces of the pressure rams, but it is not clamped between the pressure ram and the support elements. Depending on the intensity and range of an adjusting motion of the pressure rams of the finishing press, the film material can possibly be stretched now in some areas within the permissible limits. When the bale receptacle is moved out of the finishing press, the support elements are also moved out of the intermediate space between the film material and the pressed bale. The film material can possibly now be brought in contact over its full area with the pressed bale, which represents an especially gentle way of applying a film packaging to the material of the pressed bale. In particular, there will be no shear forces between the material of the pressed bale and the film.

After the bale receptacle has been moved out in the aforementioned manner, the pressed bale is held within the finishing press and preferably surrounded by the film loop on three sides, with two free ends of the film web projecting in the direction of the intake opening of the finishing press. These free ends may be optionally brought to a suitable length and laid around the remaining free circumferential side of the pressed bale, so that a film packaging extending around the bale in a closed web is formed. The free ends may be optionally connected with one another in a sealing manner, especially welded together.

The pressed bale can be compressed under high pressure and subjected to final pressing in the finishing press. An even more greatly compressed pressed bale is formed now. Such a pressed bale can be preferably provided with mechanical fixing means, e.g., straps, which hold the pressed bale in the compressed form and prevent its expansion for storage or removal.

The packaging system may preferably have a fixing device, especially a strapping device. Such a strapping device may preferably have a strapping apparatus for applying a strap on the pressed bale in such a way that it extends around the pressed bale, and the strapping apparatus preferably has a deflecting means or cooperates with a deflecting means. A strapping apparatus may be arranged, for example, on the basic carrier and especially on the side thereof pointing away from the bale receptacle. As a result, a transporting device can be designed both to transport pressed bales and to apply straps, which reduces the amount of devices needed. As an alternative, a strapping device with a strapping apparatus may be arranged in the area of the finishing press, in which case a deflecting means, with which the strapping apparatus can cooperate, is preferably arranged at the packaging system.

The strapping apparatus and the deflecting means may be preferably fed in case of a completely compressed pressed bale that is still in the finishing press on the sides of said pressed bale that are accessible from the outside. A deflecting means may be preferably provided with one or more channels for guiding a strap. The one or more channels may preferably correspond to one or more recesses in the active surfaces of the pressure rams of the finishing press.

A guide channel extending around the pressed bale in an annular pattern can thus be formed for a strapping strap by the strapping apparatus, the recesses in the pressure rams and the deflecting means.

A strapping strip can be moved by the strapping apparatus, for example, through a recess in the upper pressure ram and led to the deflecting means located on the opposite side of the pressed bale. The strip can be deflected there through a channel and can be led to a recess in the active surface of the lower pressure ram. During a further feed of the strip through the strapping apparatus, the strip can be returned through the recess in the lower pressure ram to the strapping apparatus, where the strip can be preferably joined, especially welded together, into a ring-shaped strapping. It may be preferably possible in case of a combination of the packaging system with a strapping device to apply a thin film packaging surrounding the pressed bale in a ring-shaped pattern to the pressed bale and to subsequently strap the pressed bale, so that the strapping bands have no direct contact with the bale material. The bale material can thus be protected from contamination and damage due to the strapping bands.

A bale press plant according to the present invention has at least one baling press with at least one press, e.g., a prepress, for compressing, especially precompressing pressed bales, as well as a transporting device for the (pre)compressed pressed bales. It may have, furthermore, a packaging device of the type proposed. The bale press plant may preferably have, furthermore, another press, especially a finishing press, and optionally a packaging station. Such a bale press plant may comprise, in particular, a plurality of prepresses and a transporting device, which serves the plurality of prepresses, so that the bale press plant can operate especially efficiently and produce an especially large number of pressed bales in a preferably fully automated process.

On the other hand, the transporting device may also be used for any other desired configurations of bale press plants. Instead of a prepress, it is possible, e.g., to use a main press, which performs the complete pressing operation for bale production. The transporting device now receives a bale that had been subjected to final compression. A repress, which compresses the bale having been subjected to the final pressing only slightly, may be used for compressing the bale during a subsequent fixing, especially strapping, and/or packaging of the pressed bale and/or removal of the pressed bale from the support elements or fork tines.

The pressed bales may be provided in the bale press plant by the packaging device with a first film packaging and a strapping applied over the latter. The pressed bales may be additionally provided in a packaging station with another additional packaging, which preferably covers the other, still open sides of the pressed bale. Such an additional packaging may be formed especially preferably by a hood packaging. Such a hood packaging may be overturned, for example, over the pressed bale as an elastic stretch hood, especially as a stretch hood having elongation elasticity, and the hood preferably covers an upper side and four outsides of the pressed bale and optionally also encloses partially the underside of the pressed bale with the edge areas. An especially material-saving overall packaging surrounding the pressed bale on all sides can be formed in this manner.

As an alternative or in addition, a pressed bale may be provided with a wrapping at a separate packaging station. Such a packaging station may be designed independently from the aforementioned packaging device.

In particular, a pressed bale, e.g., a precompressed pressed bale or a pressed bale having been subjected to final compression, can be moved by a bale receptacle from a press to a packaging station. The packaging station may be designed separately and does not have to be in direct connection with a press. A wrapping can be applied at the packaging station to the pressed bale being held in the bale receptacle, and this wrapping may be possibly closed later to form an all-round packaging. The wrapping may be especially a one-part or multipart tube or hood packaging. After pulling over or overturning the tube or hood packaging, the pressed bale may be optionally received supportingly in the packaging station between two pressure rams or holding rams. After separation of the bale receptacle from the pressed bale, the tube or hood packaging comes to lie on the pressed bale and can be optionally laid around on all sides and closed, especially welded together, in a further step. A packaging, which surrounds the pressed bale on all sides and is possibly airtight, can be produced hereby.

The tube or hood packaging may be preferably applied in a plurality of steps. It may surround the pressed bale in a first application step in a tubular manner, i.e., with two open ends, or in a hood-shaped manner, i.e., with one open end and one (pre)closed end. The tube or hood packaging may preferably have at the open ends an excess amount of packaging material, which can be placed on one or both of the other front sides of the pressed bale in a further application step and can be closed. The bale receptacle is removed between the two application steps while the pressed bale is preferably being held between two pressure rams or holding rams.

A packaging station may preferably have an applicator for applying a tube or hood packaging. The application may be, in particular, an expandable stretching frame. A plurality of shortening means, for example, four shortening means, may be arranged at it. A preferably premanufactured tube or hood packaging or a tube or hood packaging formed at the packaging station is stretched by the applicator from a folded-up form into an applicable form. This may be especially a hood shape, i.e., a packaging wrapping with a bag-like basic shape, which has a closed bottom side and closed enveloping sides as well as an open filling side. The hood packaging can be pulled over the applicator, for example, by shortening means provided for this purpose, gathered in the area of the enveloping sides. Depending on the design of the applicator, the tube or hood packaging can be prestretched for the application to the pressed bale, so that it tends to contract to a shape with smaller dimensions than in the position in which it is stretched out on the applicator. Contracting may take place, in particular, to the extent that the packaging is in contact with the pressed bale with an elastic residual stress after complete application. The prestretching of a tube or hood packaging can be preferably carried out by means of an applicator designed as an expandable stretching frame.

The stretched and optionally prestretched hood packaging can be applied to a pressed bale by means of the application, while the pressed bale is being held in a bale receptacle. The application may be preferably carried out by an overturning motion. This is a relative motion between the applicator and the bale receptacle with the pressed bale being held therein, which takes place essentially in parallel to the extension of the support elements. In case of a hood packaging, an overturning motion preferably takes place, during which the closed bottom side of the hood packaging makes contact with the side of the pressed bale, which said side is freely accessible to the outside, and the enveloping sides of the hood packaging are laid over or pulled over the adjoining circumferential sides of the pressed bale. The enveloping sides also cover at first the support arms of the bale receptacle during the pull-over or overturning motion. The bale receptacle can be subsequently pulled off from the pressed bale by a relative motion, while it is being moved in the direction of one of the open sides of the hood or tube packaging relative to the hood or tube packaging. The pressed bale may be optionally held between two pressure rams or holding rams during the pulling off of the bale receptacle. As an alternative or in addition, the pressed bale can be pushed out by a push-out device relative to the bale receptacle.

The application of a tube or hood packaging may take place on pressed bales at different stages of the process. For example, a pressed bale may be present, which is produced in a single pressing operation. Such a compressed pressed bale can be preferably removed from the press by a bale receptacle and moved to a packaging station. A tube or hood packaging can be applied there such that it comes directly into contact with the pressed bale. As an alternative, the pressed bale may undergo at first a fixing, e.g., in the form of a strap, and it may be subsequently provided with a tube or hood packaging.

In an especially preferred manner, a pressed bale may be provided at a packaging station with a one-part or multipart tube or hood packaging, which sealingly surrounds the bale on all sides and is applied to the pressed bale with vacuum. Such a packaging is preferably intended to fix the pressed bale by means of vacuum, without the pressed bale requiring an additional strapping or other fixing means. An especially material-saving and rapid bale packaging can be accomplished in this manner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view of a bale press plant in a first exemplary embodiment;

FIG. 2 is a perspective view of a transporting device for pressed bales;

DESCRIPTION OF THE PREFERRED EMBODIMENTS

Figure 3:
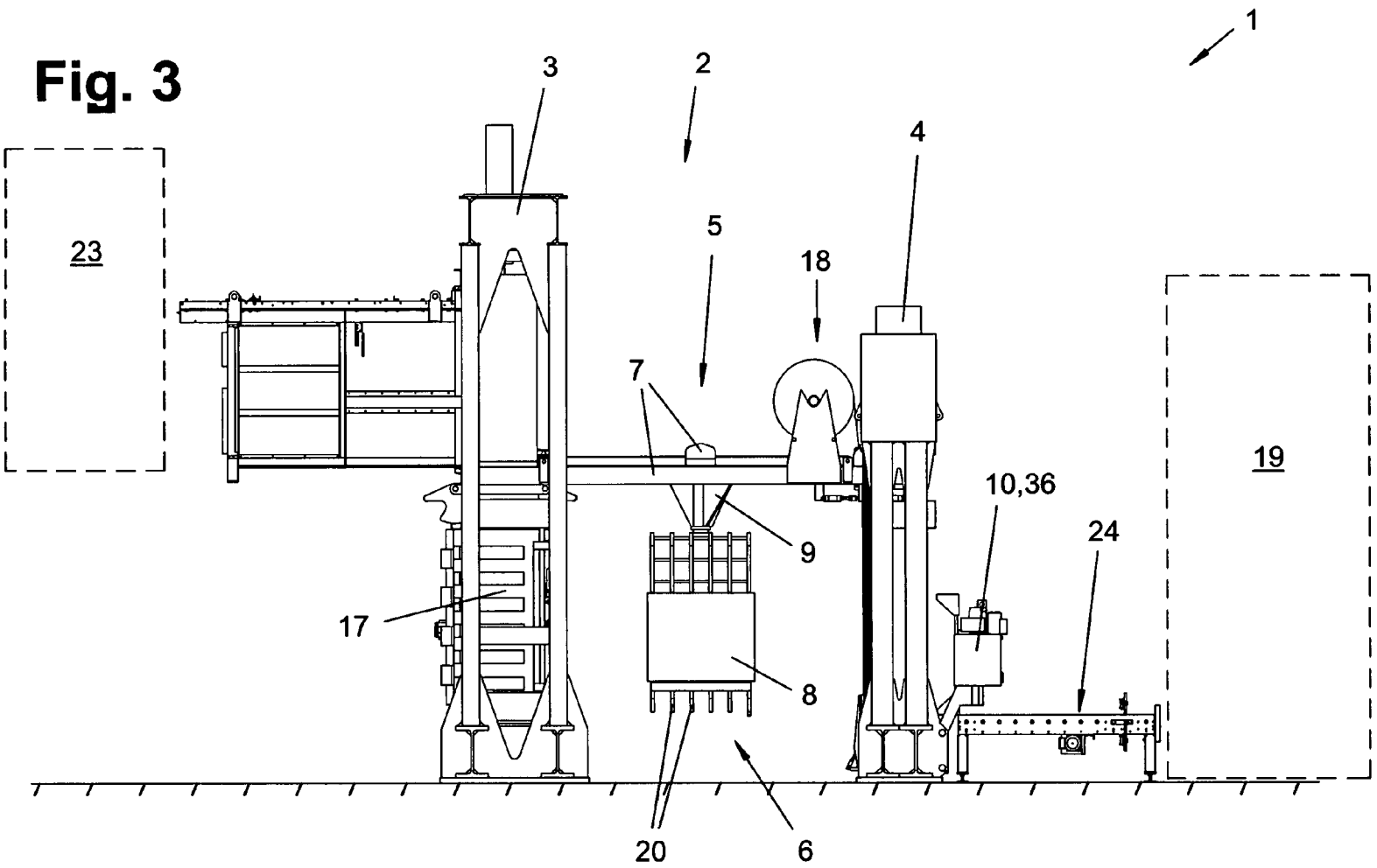
FIG. 3 is a side view of the bale press plant according to FIG. 1.

Referring to the drawings in particular, the present invention pertains to a transporting device (5) for compressed pressed bales (25). It pertains, furthermore, to a packaging technology, to a packaging device (18) for pressed bales (25) with a transporting device (5), to a packaging station (19) as well as to a bale press plant (1) with at least one bale press (2) and with a transporting device (5). The bale press (2) may be a one-part or multipart bale press and have one or more presses (3, 4) for compressing the bales.

FIG. 1 shows a bale press plant (1) with a bale press (2) and with a transporting device (5). The bale press (2) has a prepress (3) and a finishing press (4) in this exemplary embodiment. The prepress (3) can be charged via a pressing material feed unit (23). The charging may preferably take place batchwise, the bale material to be pressed being inserted in a press box (17) interactively, is amassed there and precompressed between two pressure rams (11, 12) to form a pressed bale (25). As an alternative, charging may take place in any other desired manner.

The material to be pressed may preferably consist of fibers. These may be especially fibers made of rayon, polyester, natural fibers or recycled fibers. As an alternative, other fibers or other materials may be compressed into pressed bales as desired, for example, straw or other plant parts, domestic waste or wastes or compressible metal parts.

The bale press (2) has a finishing press (4) with an upper pressure ram (13) and with a lower pressure ram (14) in the exemplary embodiment. A precompressed pressed bale (25) can be placed into the finishing press and subjected to final compression under high pressure to form a highly compressed pressed bale (25). Such a highly compressed pressed bale may be subsequently provided, e.g., with a fixing means (31), e.g., a strapping, and discharged via a conveyor (24) or a bale removal means.

The bale press plant (1) has a transporting device (5). The transporting device (5) is provided with a bale receptacle (6) for retaining a pressed bale (25), e.g., a precompressed pressed bale (25), with the pressed bale being held on two opposite sides. These are, e.g., the pressure sides, via which the pressed bale (25) is subjected to pressure and compressed. The bale receptacle (6) has a plurality of elongated, for example, rod-shaped or beam-shaped support elements (20), which are located at spaced locations from one another, on the sides intended for retaining the pressed bale (25). Such a transporting device (5) with a bale receptacle (6) is shown in FIG. 2. The bale receptacle (6) being shown is designed, for example, as a supporting fork.

The support elements (20) are arranged on a basic carrier (21) of the bale receptacle (6), e.g., on the mutually opposite side edges thereof. The support elements (20) and the basic carrier (21) may be preferably designed as clamps or forks, and an essentially cuboid receiving area is formed between the support elements and the basic carrier. In particular, the support elements (20) may be arranged in a regular pattern in the manner of fork tines. An upper set and a lower set of support elements (20) may be formed especially at the bale receptacle (6). The support elements (20) within one set may preferably have an identical design and be arranged in parallel to one another. Furthermore, they may be arranged at uniformly spaced locations from one another. The number, size and arrangement of the support elements (20) may vary depending on the size of the pressed bale (25).

As is illustrated as an example in FIG. 2, the shape and arrangement of the support elements (20) may preferably correspond to recesses (16) in the active surface (15) of at least one pressure ram (11, 12, 13, 14) of a bale press (2, 3, 4). The support elements (20) can dip, as a result, into the recesses (16). The support elements (20) may have the same distance from each other as do the recesses (16) in the pressure rams (11, 12, 13, 14). In particular, the pressure rams (11, 12, 13, 14) may preferably have recesses arranged in the same manner and with correspondingly identical shape. The width of a support element is preferably smaller than the opening width of a recess (16), so that the support elements (20) can be inserted into the recesses (16) in the direction of their longitudinal axis. The support elements (20) and the recesses (16) are preferably stretched in an elongated form and straight.

The basic carrier (21) and the support elements (20) may have a layered construction. As is shown in FIG. 2, one layer each may be formed by a clamp- or fork-shaped sheet metal or plate part, which now forms an upper support element (20) and a lower support element (20) as well as a part of the basic carrier (21). A plurality of such sheet metal or plate parts may be connected with one another in parallel to one another and at spaced locations from one another, and the support elements (20) form the bale receptacle (6) together with the basic carrier (21). As an alternative, the bale receptacle may have any other design as desired.

The bale receptacle (6) is preferably mounted rotatably on a bracket (9). The bracket (9) may be part of a manipulator (7) or connected to a manipulator (7). A moving device is formed for the bale receptacle (6) via the manipulator (7) and possibly the bracket (9). The manipulator (7) is preferably designed to move a bale receptacle (6) between at least one prepress (3) and a finishing press (4). As an alternative or in addition, the manipulator (7) may be designed to move the bale receptacle (6) to a packaging system (18) and/or to a packaging station (19).

Figure 5:
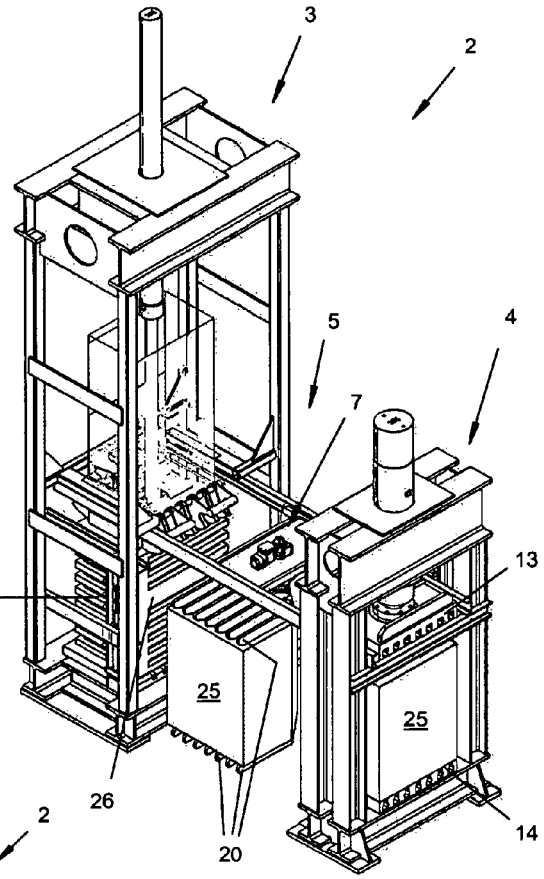
FIG. 5 is a view of an exemplary embodiment of a bale press with one of different transporting devices.
Figure 6:
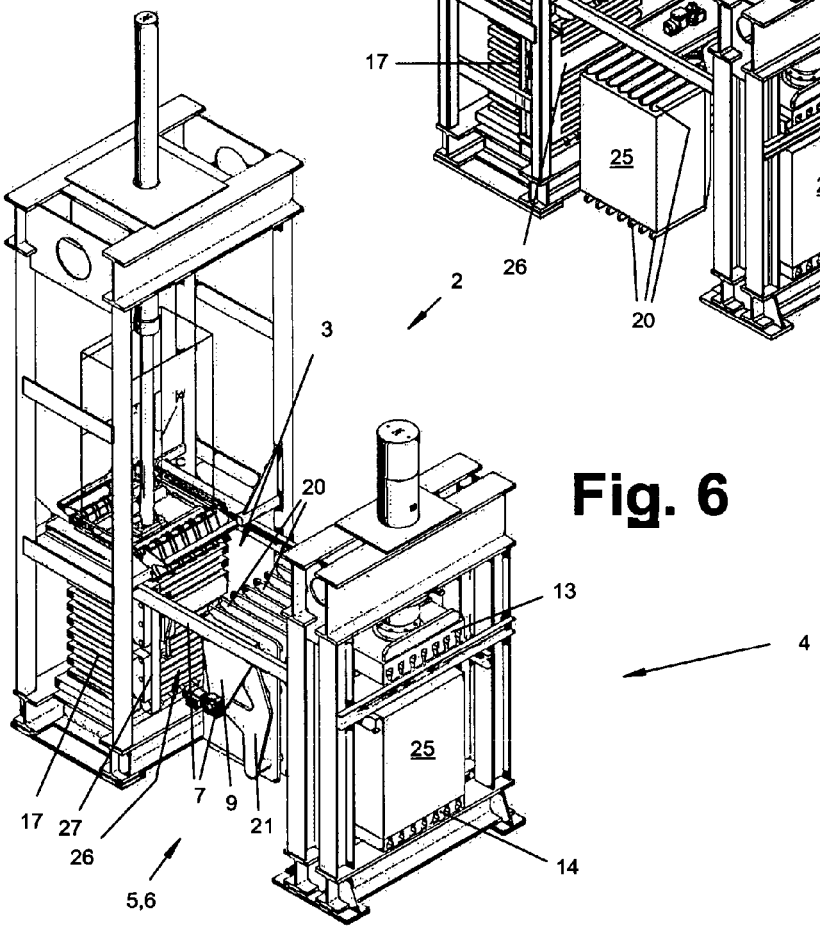
FIG. 6 is a view of an exemplary embodiment of a bale press with another of different transporting devices.
Figure 7:
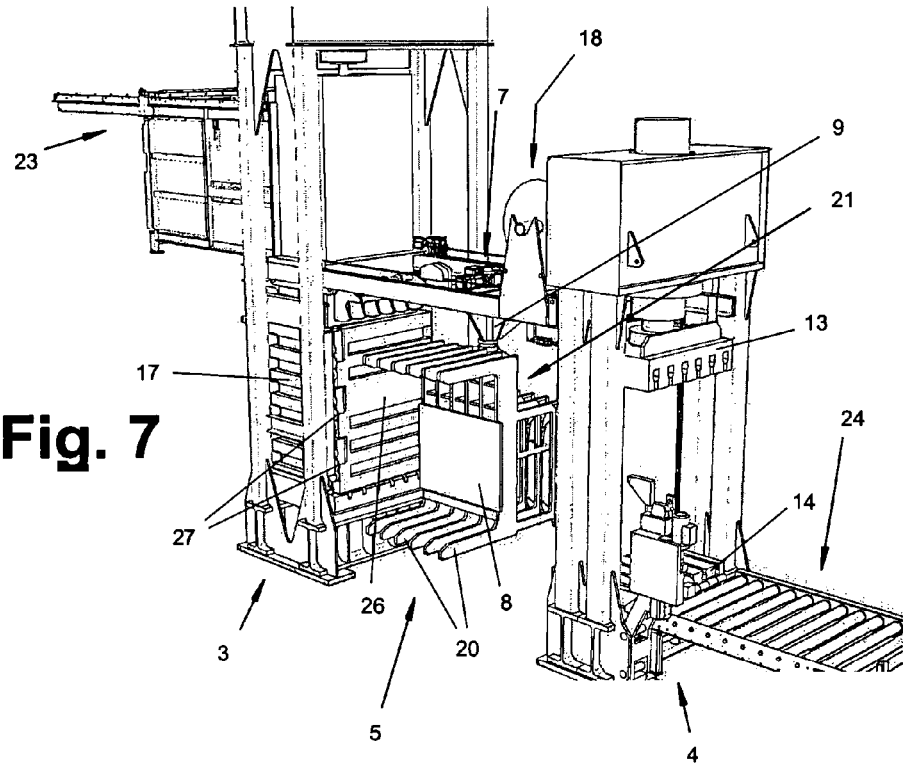
FIG. 7 is an exemplary perspective view showing an aspect of a work process of a bale press plant according to FIG. 1 with a transporting device and a packaging device.

The bale receptacle (6) and the manipulator (7) may have any desired design. FIG. 5 shows an exemplary embodiment of a bale press (2) with a prepress (3) and with a finishing press (4), wherein a manipulator (7) is arranged in the form of a cross slide manipulator between a prepress (3) and a finishing press (4). The bale receptacle (6) is connected with the manipulator (7) via a bracket (9) and can be driven and positioned by rotatory motion about a vertical axis and can be driven and positioned by translator motion along a vertical axis. In an alternative exemplary embodiment according to FIG. 6, a bale receptacle (6) is mounted in a bracket (9) having an alternative design and can be driven and positioned by rotatory motion about a horizontal axis. A manipulator (7) may also be designed as a multiaxial industrial robot with, for example, four, five, six or seven axes of motion.

Figure 4:
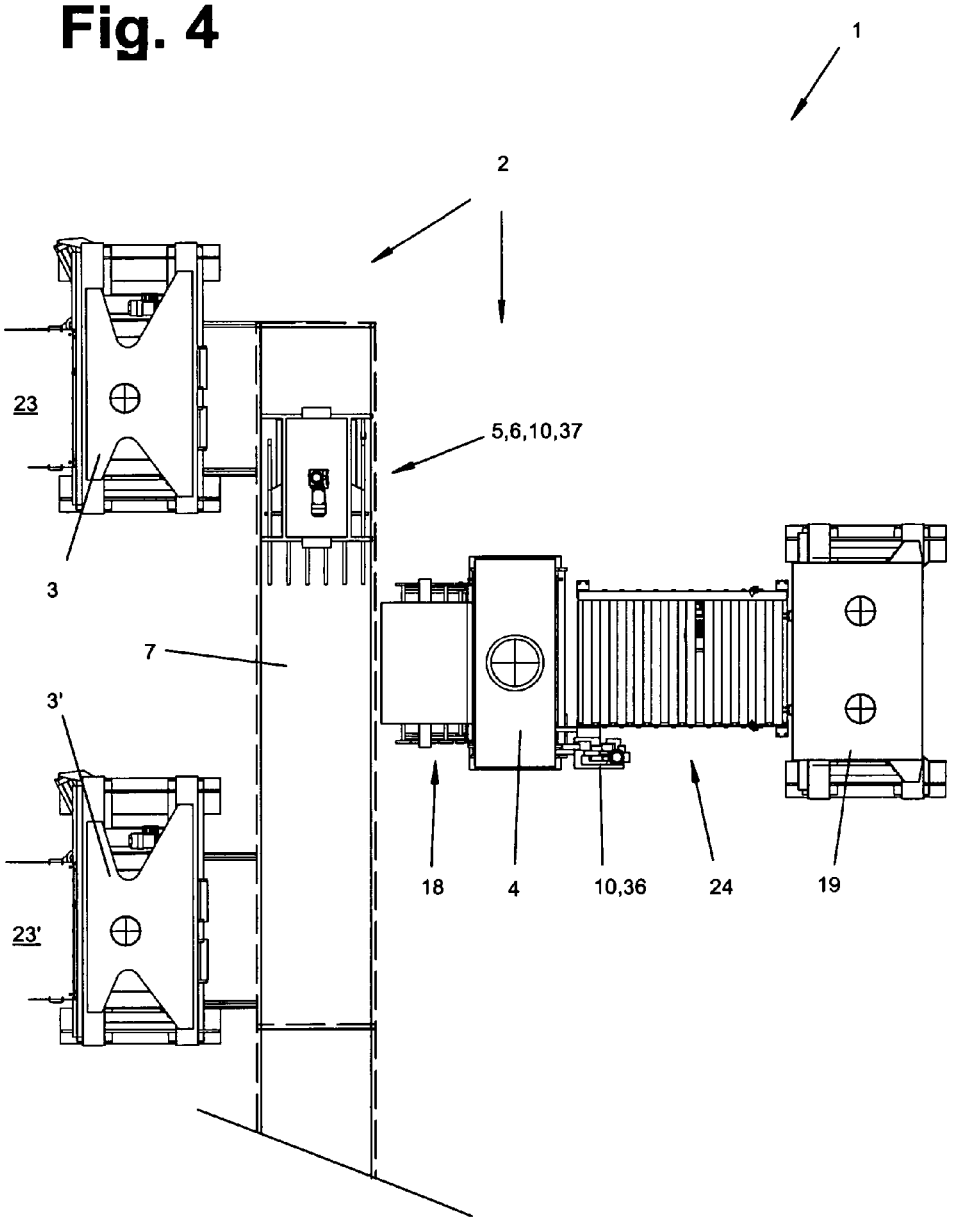
FIG. 4 is a top view of a bale press plant according to a second exemplary embodiment.

FIG. 4 shows another exemplary embodiment of a bale press plant (1). The bale press plant comprises here a bale press (2) with a first prepress (3) and with a second prepress (3') as well as a finishing press (4). A manipulator (7) is designed as a biaxial cross slide manipulator with two vertical axes of motion and is arranged in an area between the prepresses (3, 3') and the finishing press (4). A bale receptacle (6), which can be moved between the prepresses (3, 3') and the finishing press (4), is arranged at the manipulator (7). The bale receptacle (6) is connected here with the manipulator (7) via a bracket (9) and can be driven and positioned by rotatory motion about a vertical axis and can be optionally driven and positioned by translator motion along a vertical axis.

A bale press plant (1) may preferably have a packaging system (18). The packaging system (18) is designed to apply a film packaging (32) to a precompressed pressed bale (25). It has means (30) for forming a stretched film web (28), especially a film curtain (28). The packaging system (18) may have, in particular, a film storage means (29), for example, a film coil, and a film gripper (30). It is preferably arranged on a feed side of a finishing press (4). As an alternative, a packaging system (18) may be arranged at any other desired location. A bale press plant (1) may also be designed without a packaging system (18).

FIG. 3 shows a bale press plant (1) with a preferred embodiment of a packaging system (18) in a lateral view. The packaging system (18) have a film coil (29) here, which is arranged in an area above the feed opening of a finishing press (4). A film can be pulled downwardly from the film coil (29) to form a stretched film web, especially a film curtain (28), by a film gripper (30). The film curtain (28) may preferably now cover the feed opening of the finishing press (4) with a stretched film web.

The packaging system (18) may have a transporting device (5) with a movable bale receptacle (6) for receiving a precompressed pressed bale (25) or cooperate with such a transporting device (5). The transporting device (5) may have any desired design. It may be, in particular, a transporting device (5) proposed according to the present invention.

The bale receptacle (6) may be able to be moved through a stretched film web, especially through a film curtain (28). The film web (28) may be fed preferably at at least one end, for example, by pulling off the film from the foil storage means (29). The film web (28) forms a loop around the bale receptacle (6) and the pressed bale (25) being held therein while the bale receptacle (6) is being passed through the film curtain. The bale receptacle (6) and the pressed bale (25) can be preferably enveloped by the film on three sides in this manner.

The transporting device may preferably have a push-out plate (8). The push-out plate may have any desired design. A preferred embodiment of a push-out device is shown, for example, in FIG. 2. It has a push-out plate, which is directed essentially at right angles to the longitudinal axis of the support elements (20) of the bale receptacle (6) and can come into contact with a rear side of a pressed bale (25) inserted into the bale receptacle (6). The pushing plate may be preferably able to be moved by translator motion, driven and pushed out in parallel to the longitudinal axis of the support elements (20). By actuating the push-out device (8), a pressed bale (25) can be pushed out of the bale receptacle (60. The pressed bale (25) can now slide along the surfaces of the support elements (20) pointing towards the inside of the bale receptacle (6). The push-out device (8) may preferably cover the entire free surface area between the upper and lower support elements (20) and hence possibly the entire surface of a rear side of a pressed bale (25). As an alternative, a push-out device (8) may have any other desired design.

FIGS. 7 through 21 show the mode of operation of a preferred embodiment of a bale press plant (1). The mode of operation of a transporting device (5), of a packaging system (18) and of a bale press (2, 3, 4) are shown combined. However, the corresponding process steps may also be carried out independently from one another. In particular, a bale press plant (1) may also be designed without packaging system (18).

The bale press plant (1) shown in FIGS. 7 through 21 has a bale press (2) with a prepress (3) and with a finishing press (4). A transporting device (5), which has a bale receptacle (6) movable via a multiaxial manipulator (7), is arranged between the prepress (3) and the finishing press (4).

The transporting device (5) may have a fixing device (10) for the pressed bale (25), e.g., a strapping device. The strapping device (10) comprises a deflecting means (37) with one or more strapping channels for guiding a strapping (31). The deflecting means (37) is arranged on a basic carrier (21) of the bale receptacle (6). It is arranged here on the rear side for the clamp-like opening of the bale receptacle (6). As an alternative, a strapping device (10) may be arranged at the transporting device (5) in another manner, for example, as a separately movable unit without connection to the bale receptacle (6).

In the exemplary embodiment according to FIGS. 7 through 21, the bale receptacle (6) has two sets of upper and lower support elements (20). The support elements (20) of one set are always arranged in parallel to one another and at spaced locations from one another. The arrangement of the upper support elements (20) and of the lower support elements (20) is essentially identical. The arrangement of the support elements (20) always corresponds to recesses (16) in the active surfaces (15) of upper pressure rams (11, 13) and lower pressure rams (12, 14) of the prepress (3) and of the finishing press (4).

The prepress (3) has a press box (17) with a press box door (26). Material to be pressed is amassed, optionally batchwise, within the press box (17) and precompressed to a pressed bale (25). A lower pressure ram (12) is arranged on the underside in the press box. An upper pressure ram (11) can be movably guided in the press box. The compressing force of the pressure rams (11, 12) is directed here essentially vertically, and the side walls of the press box (17) apply essentially a supporting force only. When the press box door (26) is opened, a pressed bale (25) formed and being held between the upper pressure ram (11) and the lower pressure ram (12) of the prepress can be accessible from the opened side.

Figure 8:
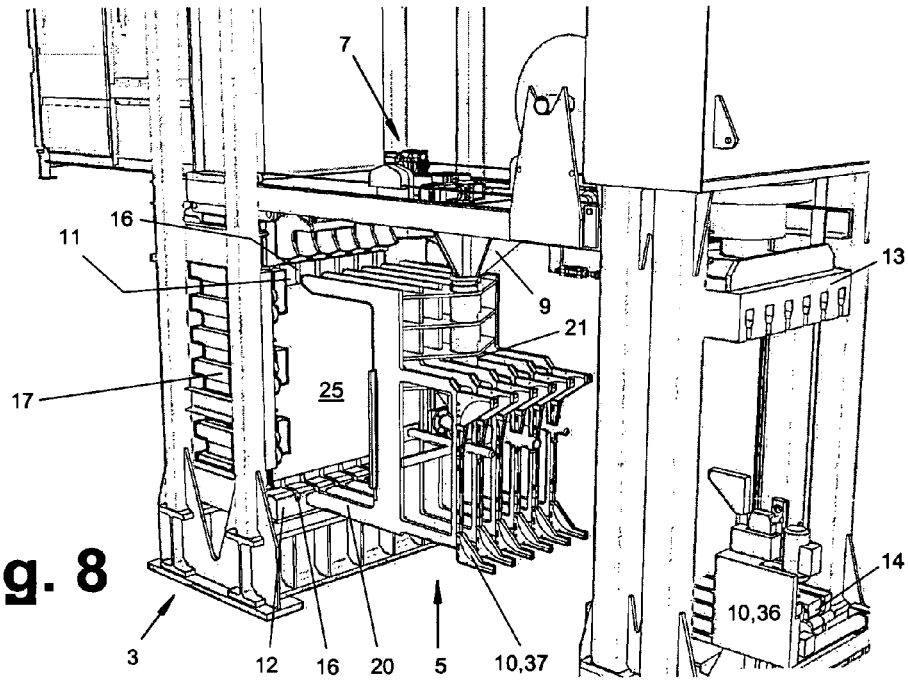
FIG. 8 is an exemplary perspective view showing another aspect of a work process of a bale press plant according to FIG. 1 with a transporting device and a packaging device.
Figure 9:
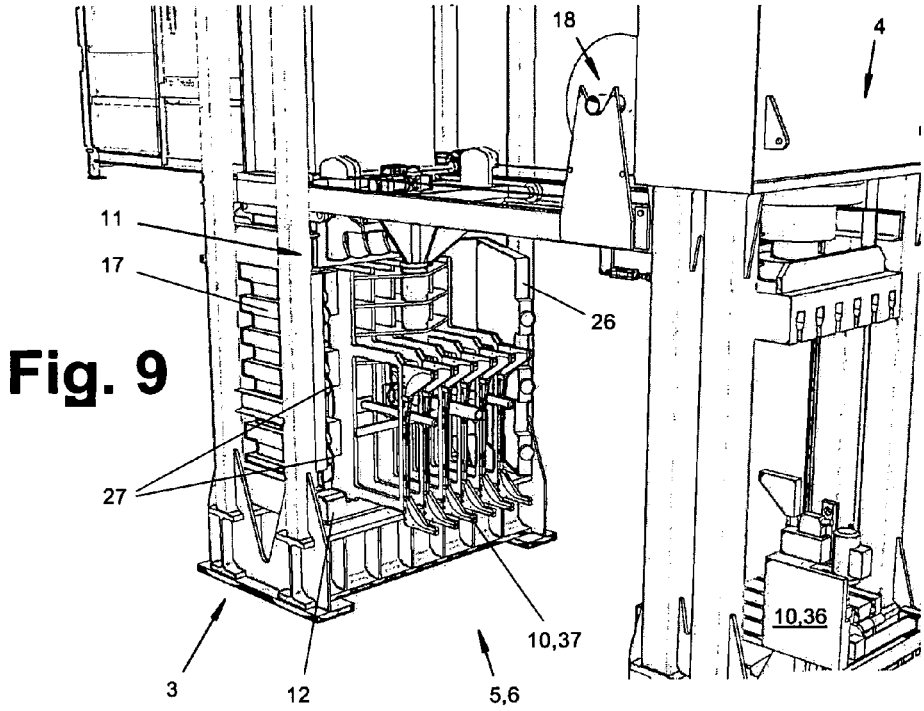
FIG. 9 is an exemplary perspective view showing another aspect of a work process of a bale press plant according to FIG. 1 with a transporting device and a packaging device.

As is shown in FIG. 8, the bale receptacle (6) can be moved into the press box (17). This preferably happens with the pressure rams (11, 12) brought together, while the support elements (20) of the bale receptacle (6) are being inserted into the recesses (16) of the pressure rams (11, 12). Due to the insertion of the bale receptacle (6) into the press box (17), the bale receptacle (6) preferably encloses the pressed bale (25) on the pressure sides thereof, here on the upper side and the underside, with the support elements (20). The support elements (20), especially the upper and lower sets of support elements (20), may have a somewhat greater distance between them than the height of the pressed bale. The bale receptacle (6) can thus be inserted with the support elements (20) into the press box (17) in an extensively or entirely contact-free manner. FIG. 9 shows a fully inserted position of the bale receptacle (6) in the press box (17).

The upper pressure ram (11) of the prepress (3) can be preferably raised upward or pulled off in the inserted position of the bale receptacle (6). The precompressed pressed bale (25) is relieved now in its vertical direction and can expand in the vertical direction due to its elastic prestress. The precompressed pressed bale (25) now comes into contact with the support elements (20) of the bale receptacle (6). The bale receptacle (6) may optionally be raised slightly simultaneously with the relieving motion of the upper pressure ram (11), so that the precompressed pressed bale (25) is lifted off on its underside from the lower pressure ram (12). As an alternative, another combination of the motion of the upper and/or lower pressure rams (11, 12) and/or of the bale receptacle (6) may take place. In particular, the bale receptacle may perform, as an alternative or in addition, a slight tilting motion, during which the free ends of the lower support elements (20) are raised, so that the pressed bale (25) is entrained in the direction of the basic carrier (21) of the bale receptacle (6). Holding of the pressed bale (25) in the bale receptacle (6) can be additionally supported in this manner.

The precompressed pressed bale (25) is held especially by its internal stress after its expansion in the bale receptacle (6) between the support elements (20). When the bale receptacle (6) is pulled out of the press box (17), the precompressed pressed bale (25) can thus be moved along and removed from the press box (17).

As is shown in FIGS. 10*ff*, the bale receptacle (6) can preferably be moved by the manipulator (7) from the prepress (3) to the finishing press (4). The bale receptacle (6) can be optionally pivoted or tilted now about a vertically or horizontally directed axis of rotation, as this is also shown in the exemplary embodiments of a bale press according to FIGS. 4 and 5.

Figure 10:
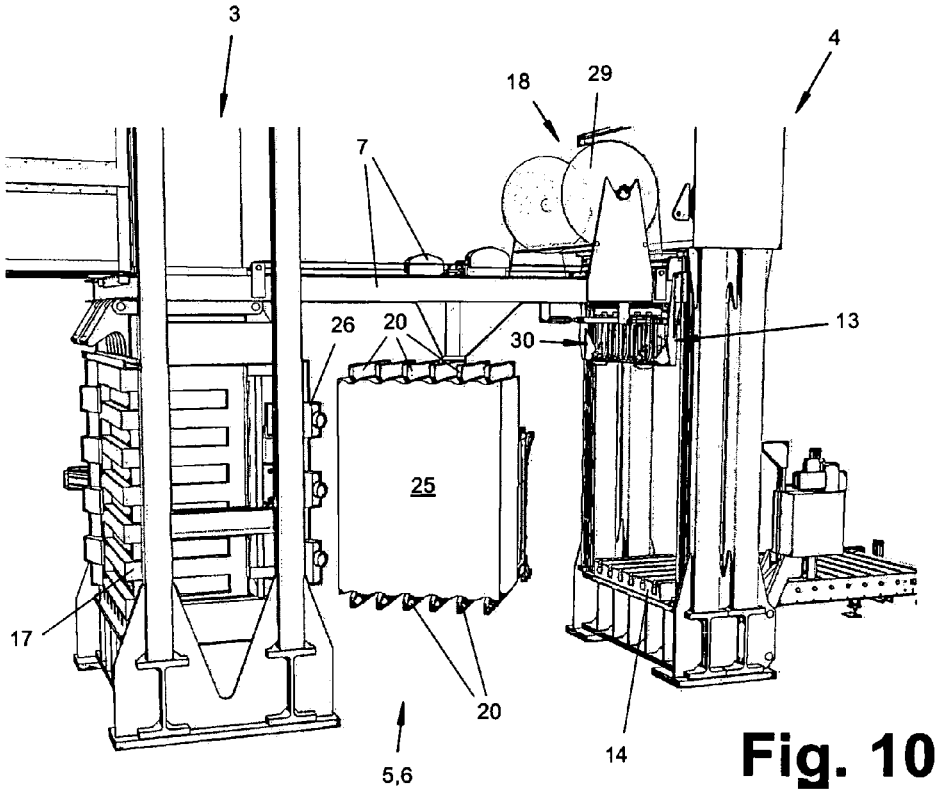
FIG. 10 is an exemplary perspective view showing another aspect of a work process of a bale press plant according to FIG. 1 with a transporting device and a packaging device.

The bale press plant (1) may have a packaging system (18), which is preferably arranged in front of a feed opening of the finishing press (4). The packaging system (18) has a film storage means (29), from which a film web can be stretched preferably in the form of a film curtain (28) in front of the feed opening of the finishing press (4). FIG. 10 shows, for example, a packaging system (18) with a vertically displaceable means (30) for stretching a film web (28). The means (30) may be especially a film gripper, which picks up a free end of the film from the film storage means (29) and pulls it downward, while the film forms a film curtain (28) shown in FIG. 11 in front of the feed opening of the finishing press (4).

The bale receptacle (6) can be inserted into the finishing press (4) through the film curtain (28). The film curtain (28) can be held now at the lower end, while film material can be fed from the upper end, for example, by pulling off from the film storage means (29). As an alternative, the stretching and feeding of the film material may take place in another suitable manner.

While the bale receptacle (6) is being pushed in and the bale receptacle (6) is moving now through the film curtain (28), the film material slides around the bale receptacle (6) and the pressed bale being held therein. The film now forms a loop and preferably covers an area of the upper side and underside of the bale receptacle (6) as well as a front face side of the pressed bale (25). It may be especially advantageous if the distance between the upper pressure ram (13) and the lower pressure ram (14) of the finishing press (4) is greater during the pushing in of the bale receptacle (6) than the vertical outer distance of the support elements (20). A free space, in which the film of the film curtain (28) can slide unhindered, can be preferably formed in this manner both between the upper support elements (20) and the upper pressure ram (13) and between the lower support elements (20) and the lower pressure ram (14).

Sliding of the film around the bale receptacle (6) and the pressure rams (13, 14) can be additionally facilitated by device technology. For example, sliding edges (22) may be arranged at the free ends of the support elements (20) to facilitate the sliding around of a film (28). Corresponding sliding edges may likewise be provided on the pressure rams (13, 14) of the finishing press (4). Replacement means, with which sliding edges (22) can be replaced by other means facilitating the sliding of a film, for example, deflecting rollers or anti-adhesion coatings, etc., are known to the person skilled in the art.

Figure 13:
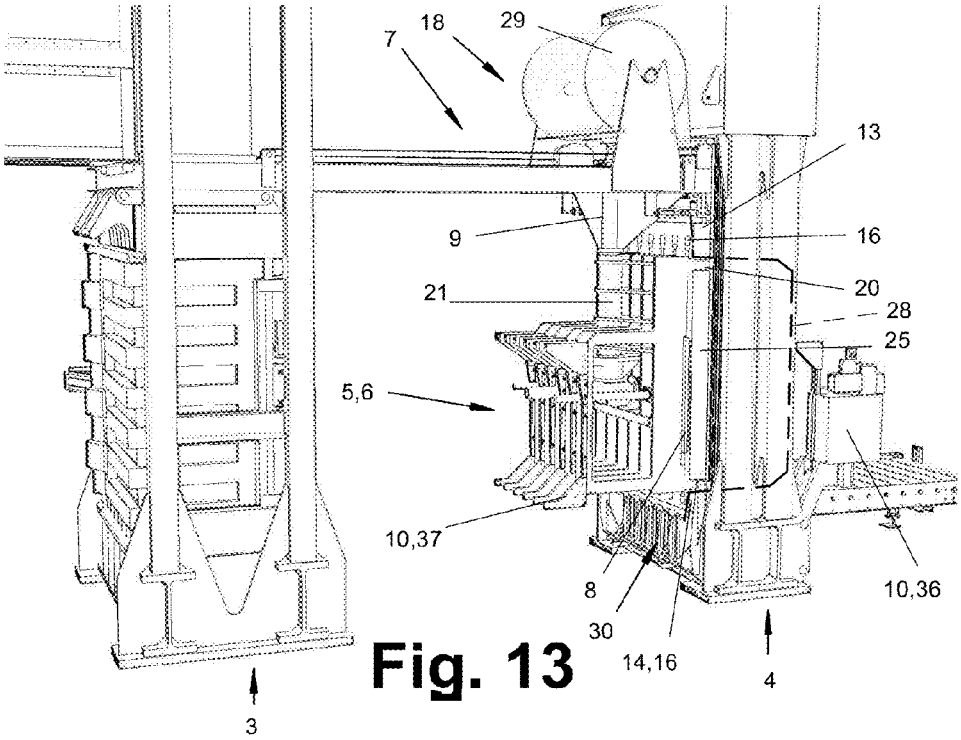
FIG. 13 is an exemplary perspective view showing another aspect of a work process of a bale press plant according to FIG. 1 with a transporting device and a packaging device.

FIG. 13 shows a bale receptacle (6) with a pressed bale (25) being held therein in the fully withdrawn position in the finishing press (4). The film web (28) runs now, starting from a film storage means (29), horizontally downwardly to a front sliding edge of the upper pressure ram (13), where it runs inwardly into the space of the finishing press (4) and is led in a free space between the upper support elements (20). Over the further course, the film web (18) then runs around the front side of the pressed bale (25) pointing toward the discharge side of the finishing press and is then led out in a free space between the lower support elements (20) and the active surface (15) of the lower pressure ram (14) to the front side. The film web (28) is held at the lower end by the film gripper (30). The film now forms a loop, which corresponds essentially to the horizontal width of the pressed bale (25) and encloses the upper side, a front side and the underside of the pressed bale (25) as well as the support elements (20) and has an upper free end and a lower free end.

Figure 14:
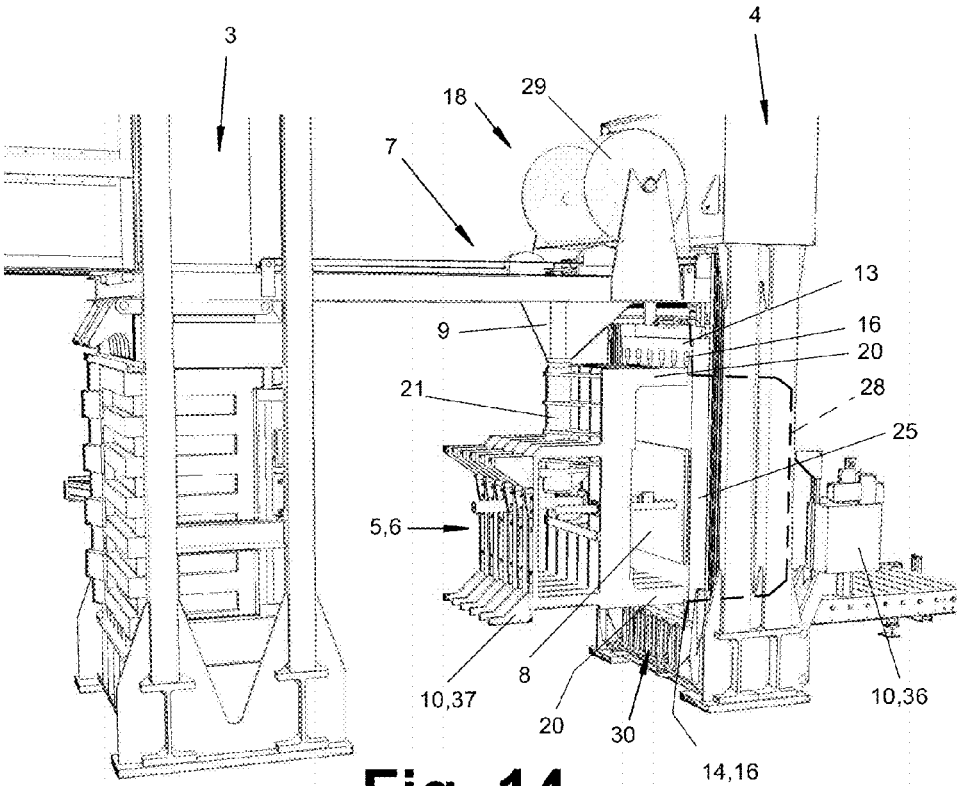
FIG. 14 is an exemplary perspective view showing another aspect of a work process of a bale press plant according to FIG. 1 with a transporting device and a packaging device.
Figure 15:
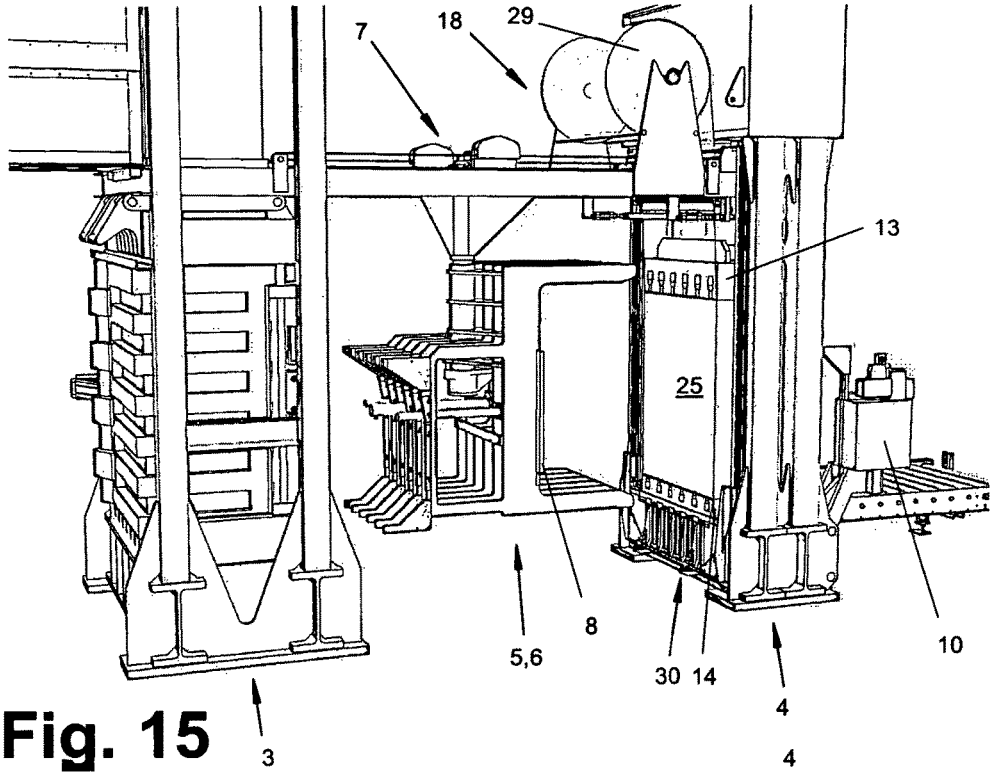
FIG. 15 is an exemplary perspective view showing another aspect of a work process of a bale press plant according to FIG. 1 with a transporting device and a packaging device.

As is shown in FIGS. 13 through 15, the bale receptacle (6) can be preferably moved out of the finishing press (4), while the pressed bale (25) remains in the finishing press (4). The bale receptacle (6) can be pulled out of the finishing press (4) while a push-out device (8) of the transporting device (5) is actuated to compensate the removing motion, so that the push-out device (8) supportingly holds the pressed bale (25) in the finishing press (4). The push-out device (8) may have any desired design here. It may preferably have a push-out plate, which can be extended relative to the bale receptacle (6) in the longitudinal direction of the support elements (20) and supports a rear side of the pressed bale (25).

The removal of the pressed bale (25) can be brought about entirely by the push-out device (8), and a holding force is optionally overcome between the upper side and the underside of the pressed bale (25) and the respective upper and lower support elements (20) of the bale receptacle (6). As an alternative or in addition, the pressed bale (25) can be picked up from the finishing press (4) and held with a limited pressing pressure before or during the removal of the bale receptacle (6) between the upper pressure ram (13) and the lower pressure ram (14). For example, the upper pressure ram (13) can be lowered with the bale receptacle (6) pushed in, and the recesses (16) in the active surface (15) of the upper pressure ram (13) leave a free space for the upper support elements (20) of the bale receptacle (6). As an alternative or in addition, the bale receptacle (6) can be lowered at the same time downwardly, and the lower support elements (20) dip into recesses (16) of the lower pressure ram (14).

The pressed bale (25) can thus be picked up clampingly between the upper pressure ram (13) and the lower ram (14). The pressure rams (13, 14) can possibly be fed to the extent that the pressed bale (25) is compressed and separates on the upper side and/or underside from the support elements (20) of the bale receptacle (6). As a result, the pressed bale (25) can be released from the bale receptacle (6), so that the holding force between the support elements (20) and the pressed bale (25) is extensively eliminated. As an alternative, the feed motion of the pressure rams (13, 14) for picking up the pressed bale (25) may take place to the extent that the holding force between the pressed bale (25) and the support elements (20) of the bale receptacle (6) is reduced. The pressed bale (25) fully or partially separated from the holding force between the support elements (20) can thus remain positioned more easily in the finishing press (4), while the bale receptacle (6) is being removed. As an alternative or in addition, the push-out device (8) can hold the pressed bale (25) in position in a supporting manner. Finally, it is possible to tilt the bale receptacle (6) from the finishing press (4) before or during the removal from the finishing press (4), so that a gradient directed toward the finishing press (4), which supports the pushing out of the pressed bale (25), is created via the support elements (20).

Figure 24:
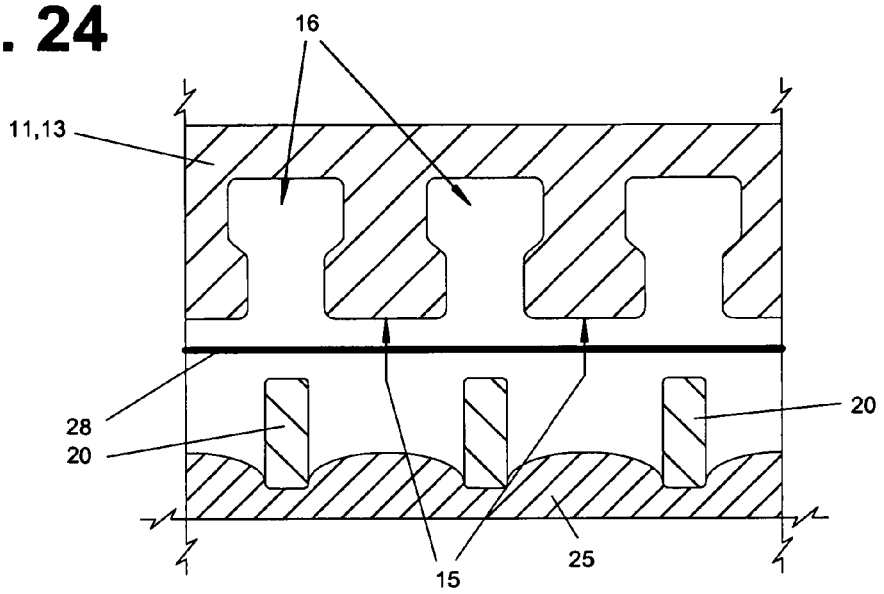
FIG. 24 is a cross-sectional view of possible positioning of pressure rams in relation to a bale receptacle with a pressed bale being held therein.
Figure 25:
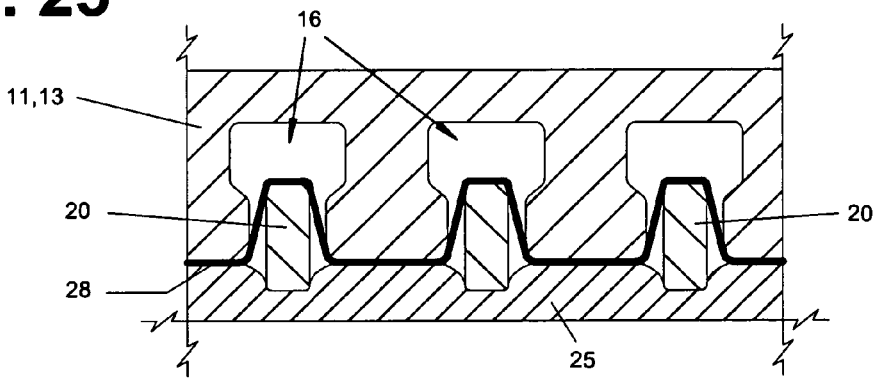
FIG. 25 is a cross-sectional view of possible positioning of pressure rams in relation to a bale receptacle with a pressed bale being held therein.
Figure 26:
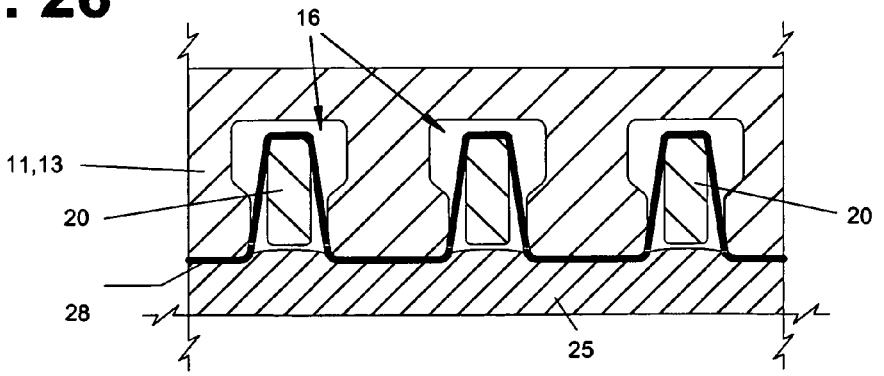
FIG. 26 is a cross-sectional view of possible positioning of pressure rams in relation to a bale receptacle with a pressed bale being held therein.

FIGS. 24 through 26 show an example of how a film web (28) can extend in the cross section between an upper pressure ram (13) of the finishing press (4) and a bale receptacle (6) with a pressed bale (25) received therein. FIG. 24 illustrates a preferred relative positioning of the pressure ram (13) and support elements (20) during the insertion of the bale receptacle (6) into the finishing press (4). A free space, in which the film web (28) can slide freely, is formed here between the active surface (15) of the pressure ram (13) and the top edge of the upper support elements (20).

FIG. 25 shows a positioning of the pressure ram (13) while the active surface (15) is partly in contact with the pressed bale (25). The pressed bale (25) may be partially compressed by the pressure ram (13), as a result of which the elastic holding force between the pressed bale (25) and the support elements (20) is reduced. The film web (28) can be contacted on both sides in such a case in the area of the active surface (15) between the pressure ram (13) and the pressed bale (25). However, the film web (28) is not contacted on both sides between the support elements (20) and the pressure ram (13), but it lies on the outer surfaces of the support elements (20) on one side only. The bale receptacle (6) with the support elements (20) can be pulled out in this positioning between the film web (28) and the pressed bale (25) without major shearing forces being transmitted to the film web (28).

When the pressure rams (13) are fed even more to the pressed bale (25), an even greater compression of the pressed bale can take place, and the contact between the support elements (20) and the pressed bale (25) may be possibly eliminated altogether. This is shown in FIG. 26. The bale receptacle (6) can be removed from the finishing press (4) in this positioning, without being in contact with the pressed bale (25) at all, so that no or hardly any shearing forces are consequently transmitted to the pressed bale (25).

The film (28) for packaging the pressed bale (25) may consist of any desired and suitable material, e.g., plastic, metal, composites or the like. The film (28) may be resistant to extension and stretching or may be elastically stretchable. It may preferably have a limited elongation elasticity. In particular, it may be stretchable to such an extent that it is stretched elastically when the support elements (20) dip into the recesses (16) of the pressure rams (13, 14).

As an alternative, a film web (28) may be led over its width with slack and possibly in some areas to form a loop, so that free film material will run into the recesses (16) when the pressure rams (13, 14) are lowered over the support elements (20) of the bale receptacle (6) without being stretched. The film web (28) is preferably also contacted on both sides only in the area of the active surface (15) between the pressure rams (13, 14) and the pressed bale (25) when the pressed bale (25) is picked up in a receiving manner. However, it is not clamped between the pressure rams (13, 14) and the support elements (20), so that the bale receptacle (6) can be removed extensively unhindered.

Figure 16:
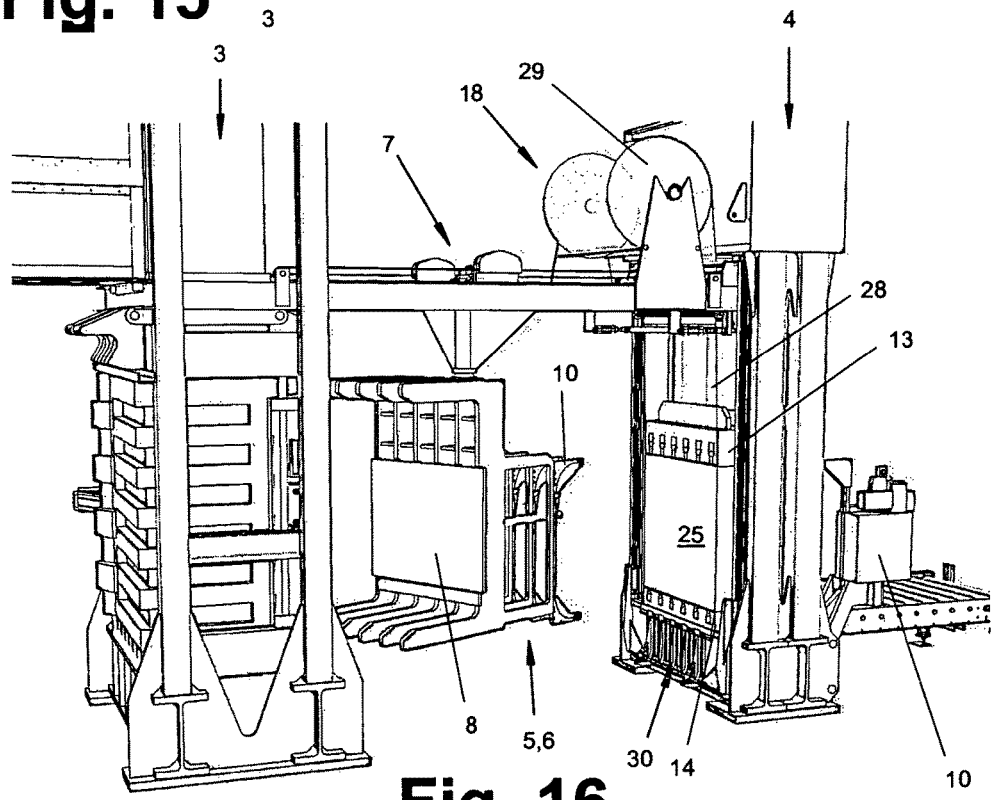
FIG. 16 is an exemplary perspective view showing another aspect of a work process of a bale press plant according to FIG. 1 with a transporting device and a packaging device.

The pressed bale (25) can be subjected, as is shown in FIG. 16, to final pressing in the finishing press (4) under high press pressure. For example, the upper pressure ram (13) can be lowered now downwardly, while the pressed bale (25) is compressed between the upper and lower pressure rams (13, 14).

Figure 17:
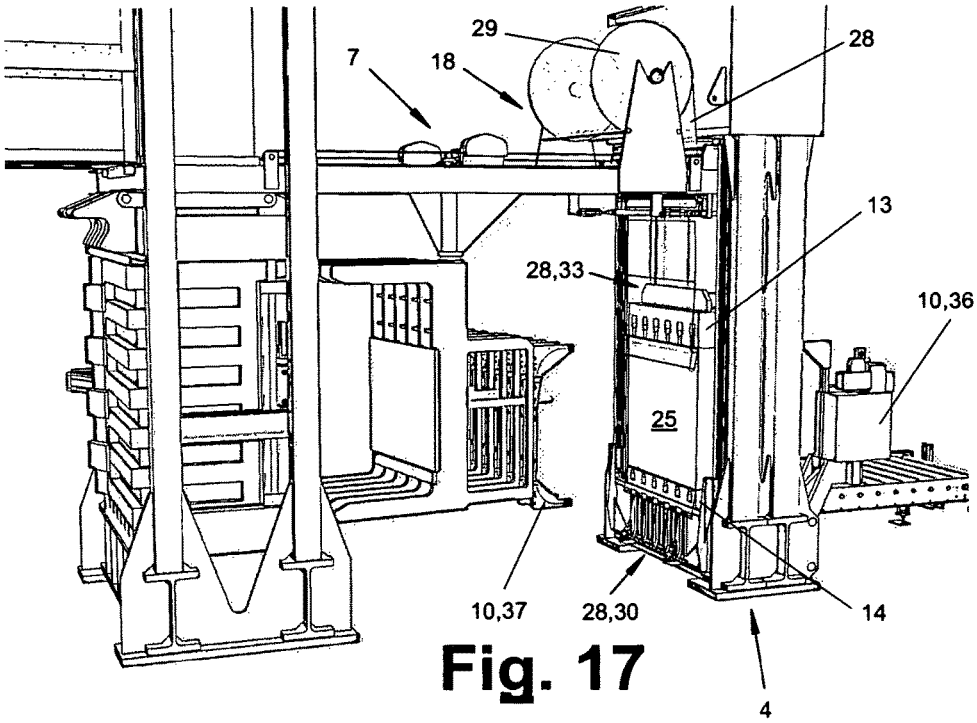
FIG. 17 is an exemplary perspective view showing another aspect of a work process of a bale press plant according to FIG. 1 with a transporting device and a packaging device.

As is shown in FIG. 17, a free and, for example, upper end (33) of the film web (28) can be laid around the still open front side of the pressed bale (25) preferably after removal of the bale receptacle (6) from the packaging system (18). The film web (28) may be possibly cut now to a suitable length. The other and, for example, lower free end of the film can be guided correspondingly. The packaging system (18) may preferably have cutting and/or joining means (30) for this, with which the film (28) can be cut into lengths and possibly fitted together, especially welded together, in two or more layers. The cutting and/or joining means (30) may be combined, for example, with the film gripper (30). The film loop laid around a pressed bale (25) on three sides can thus be closed with its free ends to form a film packaging (31) extending around the bale in a closed web.

Figure 18:
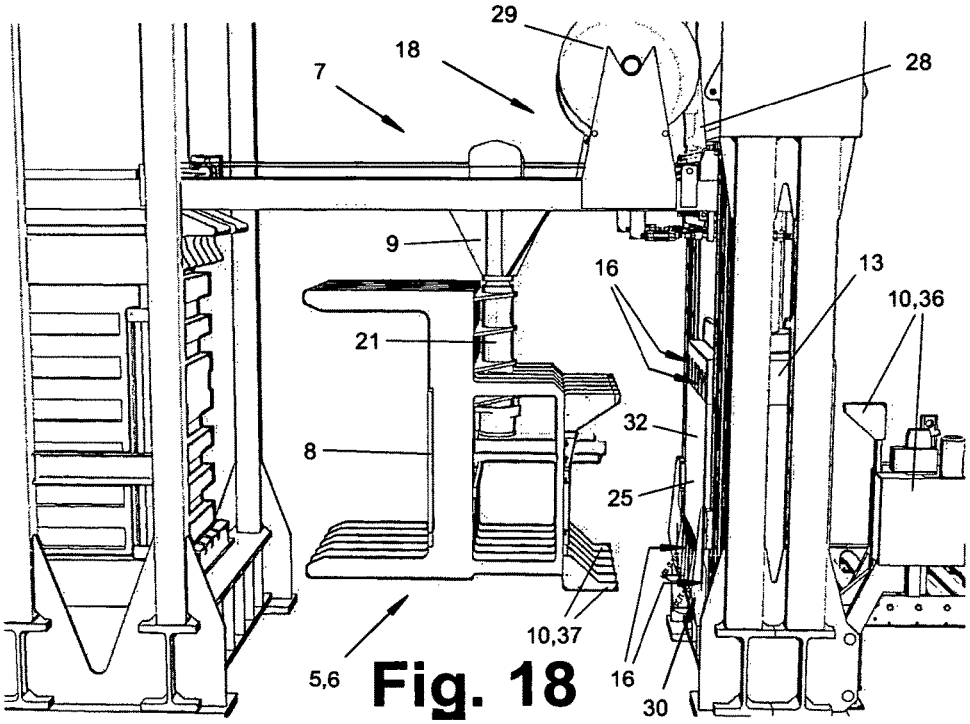
FIG. 18 is an exemplary perspective view showing another aspect of a work process of a bale press plant according to FIG. 1 with a transporting device and a packaging device.
Figure 19:
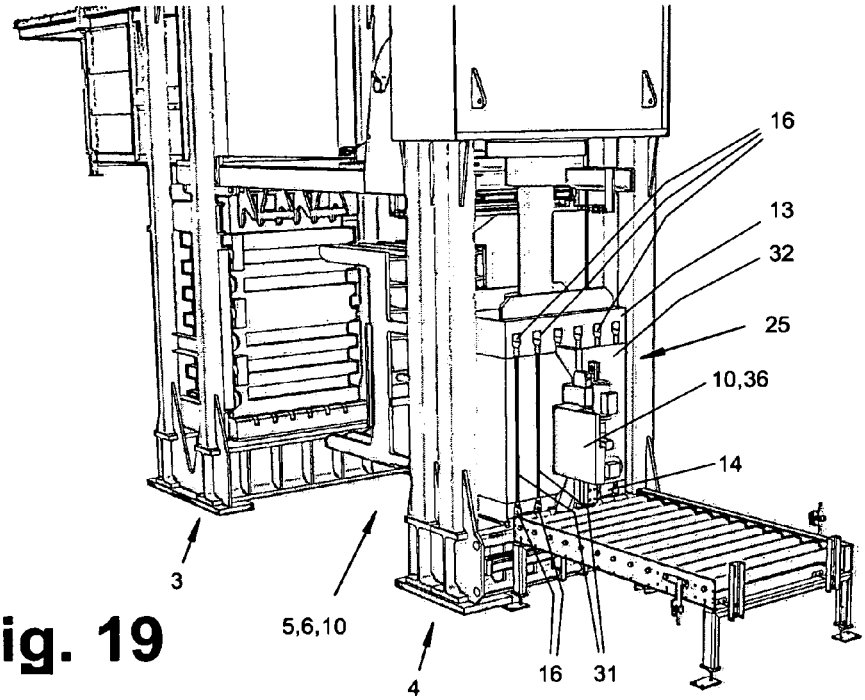
FIG. 19 is an exemplary perspective view showing another aspect of a work process of a bale press plant according to FIG. 1 with a transporting device and a packaging device.
Figure 20:
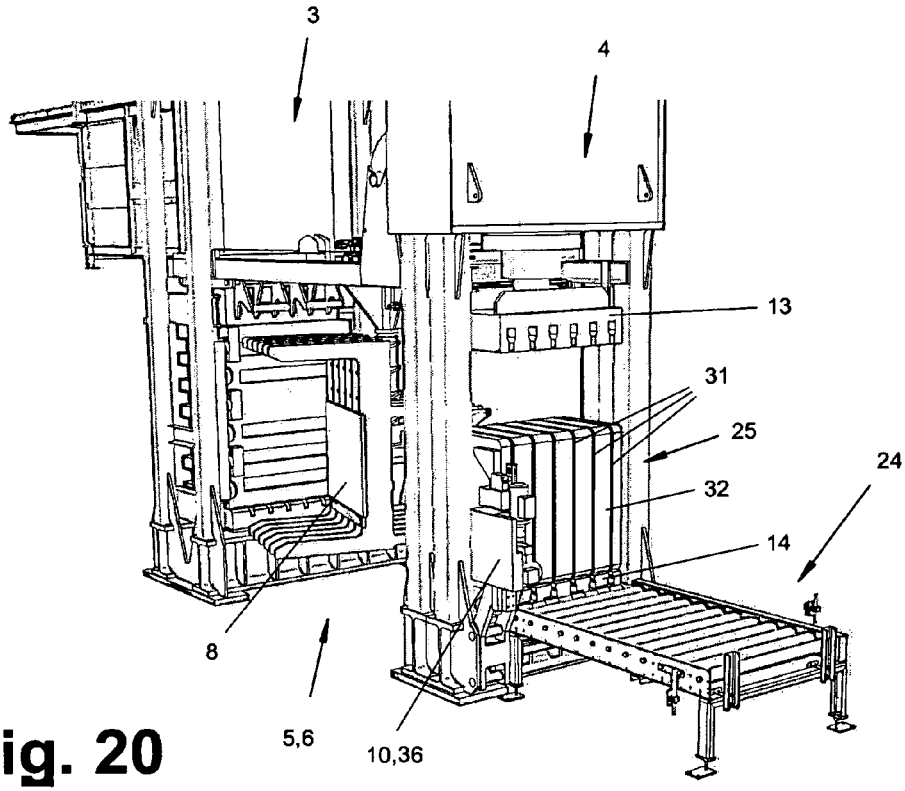
FIG. 20 is an exemplary perspective view showing another aspect of a work process of a bale press plant according to FIG. 1 with a transporting device and a packaging device.

FIGS. 18 through 20 show a preferred embodiment of a strapping device (10). The transporting device (5) comprises here a deflecting means (37) of the strapping device (10), while a corresponding strapping apparatus (36) of the strapping device (10) is arranged on the rear side of the finishing press (4). As an alternative, the arrangement of the strapping apparatus (36) and deflecting means (37) may be reversed.

The deflecting means (37) is preferably arranged on the basic carrier (21) of the bale receptacle (6). The deflecting means (37) may be designed as a rigid device, which has channels for deflecting a strapping. The deflecting means (37) may preferably be able to be fed via the manipulator (7) to the pressed bale (25) being held in the finishing press and subjected to final pressing. The channels of the deflecting means may correspond to recesses (16) in the pressure rams (13, 14) of the finishing press. A strapping apparatus (36) may be able to be fed on the opposite side of the pressed bale (25). The strapping apparatus (36) is preferably designed to push a strapping strip (31) through a recess (16) in the upper pressure ram (13). The strapping strip is picked up on the opposite side by the deflecting means and deflected downwardly through the channels of the deflecting means (37). The strapping strip (31) is returned there through a recess (16) in the lower pressure ram (14) to the strapping apparatus (36). The strapping apparatus (36) can subsequently fit together, especially weld together, the strapping strip into a ring-shaped strapping (31).

The strapping (31) may be preferably applied to a pressed bale (25) provided with a film packaging (32) on the outside. The strapping (31) is preferably wrapped around the pressed bale (25) in the same direction in which the film packaging (32) is wrapped around. The film packaging (32) can avoid in this manner a direct contact between the pressed bale (25) and the strapping (31). The pressed bale (25) is thus protected from contamination or damage to the material due to the strapping (31). The strapping device (10) may be designed, as is shown in FIGS. 19 and 20, for applying strappings (31) sequentially on the pressed bale (25). As an alternative, the strapping device (10) may be designed for applying a plurality of strappings (31) in parallel. A deflecting means (37) may correspondingly have one channel or a plurality of channels for guiding a strapping, which correspond to one or more recesses (16) on the pressure rams (13, 14).

As an alternative, a strapping or another fixing means may be placed directly on the pressed bale. This may also happen in a separate strapping station.

Figure 21:
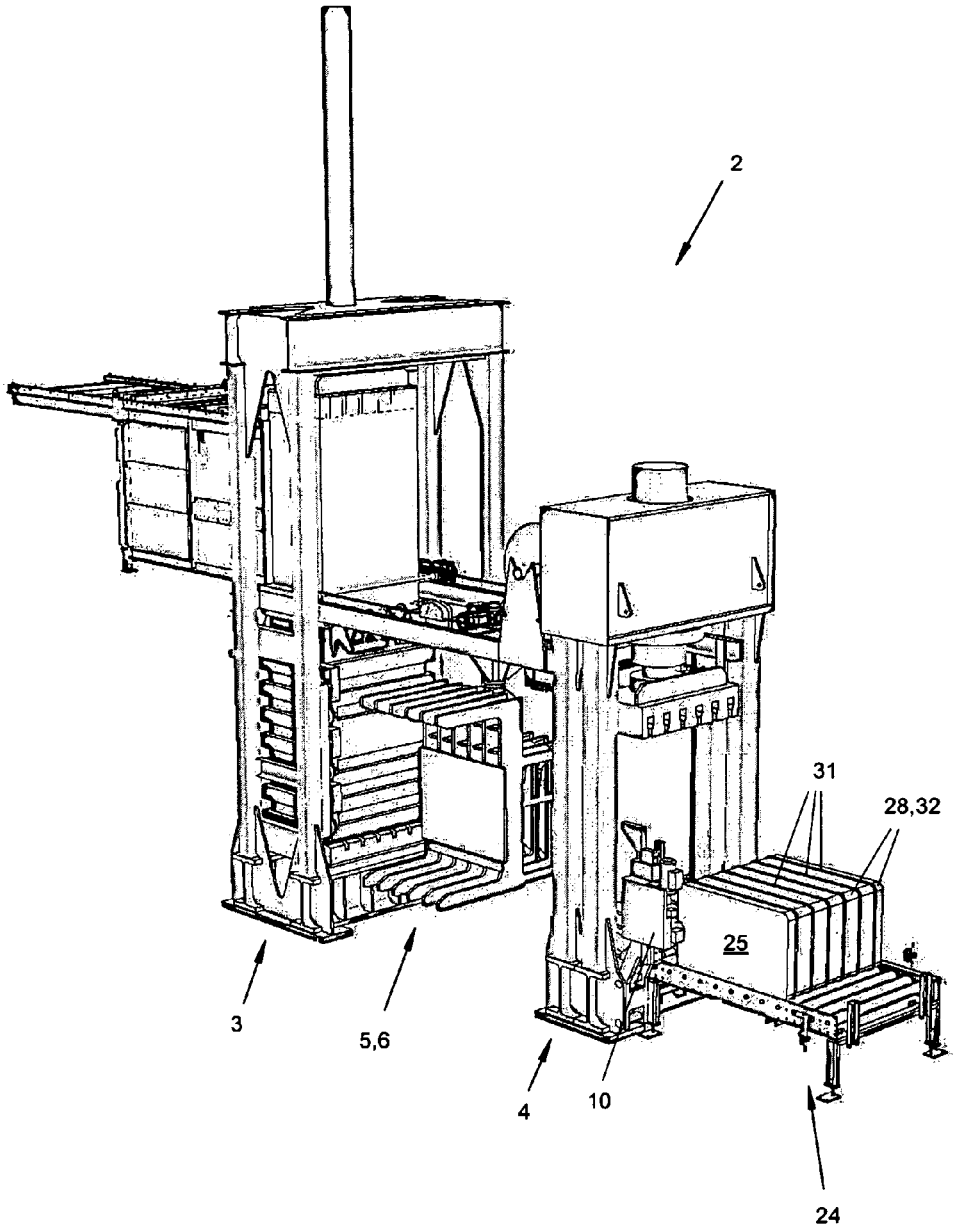
FIG. 21 is an exemplary perspective view showing another aspect of a work process of a bale press plant according to FIG. 1 with a transporting device and a packaging device.

According to FIG. 21, the pressed bale (25) can be discharged from the finishing press (4) preferably by a tilting device, which removes the pressed bale (25) from the finishing press with the pressure rams (13, 14) opened. The pressed bale (25) can be preferably placed now on a conveyor (24), which ensures the further removal of the pressed bale.

As an alternative or in addition to the packaging device (18), a bale press plant (1) may have a packaging station (19). Such a packaging station is preferably designed to place an additional packaging, which leads to packaging of the pressed bale on all sides, on the pressed bale. In a preferred embodiment, a bale press plant (1) has a packaging device (18) for applying a film packaging enclosing the pressed bale in a ring-shaped manner on four sides. A strapping (31) may preferably be placed around the film packaging. The pressed bale (25) thus prepackaged can be fed to a packaging station (19), which applies an additional packaging. Such an additional packaging may be, for example, a hood packaging, especially one made of a stretchable stretch hood. As an alternative, it may be another additional packaging, for example, in the form of a body belt or a single or double bag packaging.

The application of a stretch hood has several advantages. On the one hand, a stretch hood can be laid over the pressed bale (25) such that it fully covers five sides of the pressed bale, for example, an upper side and the four outsides, while it can be laid additionally elastically around the last side, for example, the underside, with the free hood edge area. The prepackaged pressed bale can be provided as a result with an additional packaging, which leads to coverage of the pressed bale on all sides, in only one fully automated process step. This form of packaging is consequently an especially material-saving solution and can be carried out rapidly.

On the other hand, a hood packaging can be applied to a pressed bale (25) from the top in a simple manner. The pressed bale does not require any special handling. Thus, a hood packaging can be applied directly on a pressed bale (25) being moved on a conveyor (24). To facilitate an elastic placement or wrapping of the hood packaging around the underside of the pressed bale, the pressed bale may possibly be lifted off slightly upwardly from the conveyor.

A tube or hood packaging may advantageously also be applied to a pressed bale (25) being held in a bale receptacle (6). This may preferably happen at a packaging station (19). The packaging station (19) may be provided as an alternative or in addition to a packaging device (18). After packing the pressed bale (25) in a tube or hood packaging, a pressed bale (25) may be fed for any desired further treatment, for example, for final pressing and/or to a fixing means.

Figure 22:
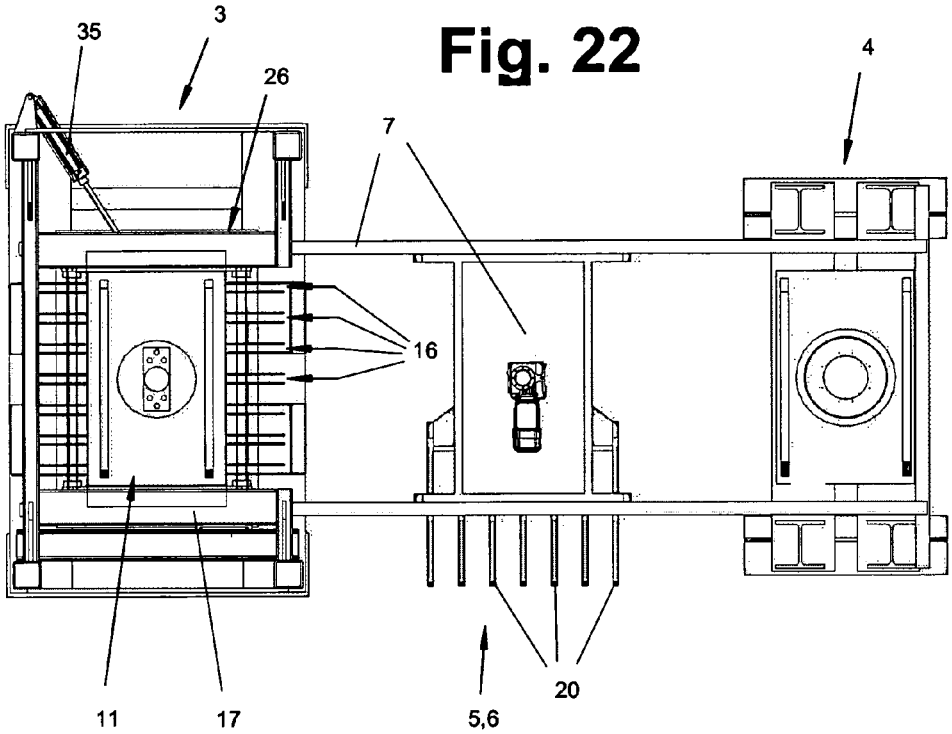
FIG. 22 is a top view of a bale press with a press box according to a preferred embodiment.
Figure 23:
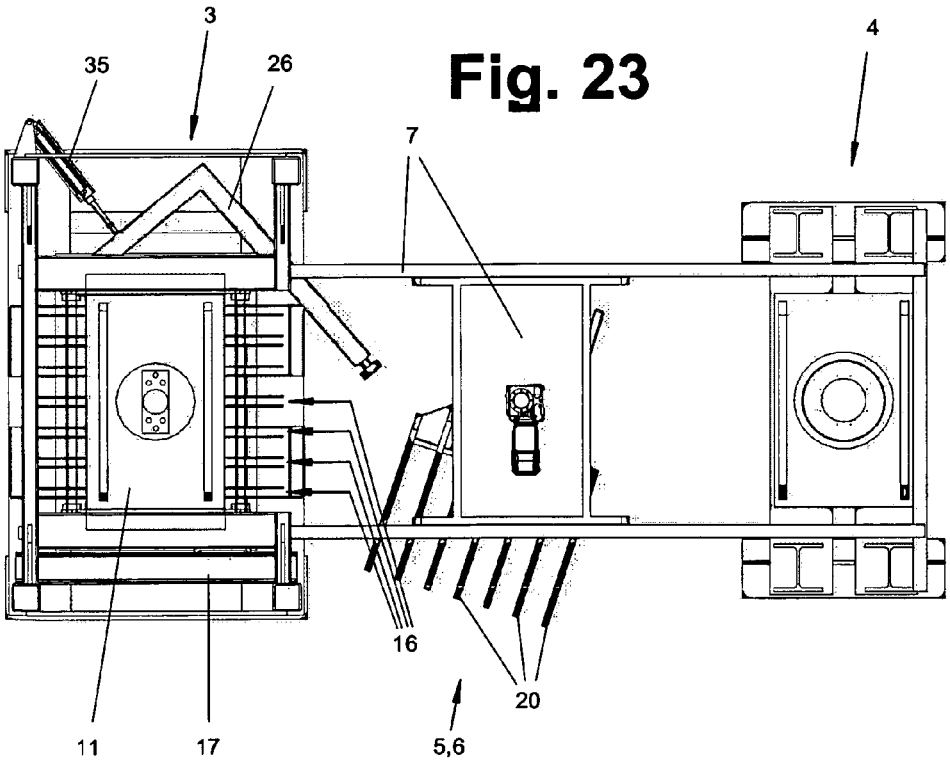
FIG. 23 is another top view of the bale press with a press box according to the preferred embodiment.

FIGS. 22 and 23 show a preferred embodiment of a press box 17 of a prepress (3). The press box (17) is essentially cuboid and its upper side and underside are formed by an upper pressure ram (11) and a lower pressure ram (12), respectively, of the prepress (3).

The press box (17) has a press box door having an L-shaped cross section. The press box door can relieve the pressed bale when opened, while there is relief along both horizontal axes at the same time. A pressed bale (25) can be freed in this manner of external stresses in the horizontal plane when opening the press box (17). The pressed bale (25) is consequently held after opening of the press box door with the L-shaped cross section in the vertical direction only by an external stress exerted by the pressure rams (11, 12). Such a design of the press box facilitates the picking up of the pressed bale by a bale receptacle (6) with the support elements (20). With the press box door (26) opened, the pressed bale (25) is not held by clamping forces in the press box (17), as a result of which the risk of unintended shearing or deformation of the pressed bale (25) is reduced.

The above-described exemplary embodiments, which are also shown in the drawings, may be varied in a variety of ways. The first press (3, 3') may be, e.g., a main press, which carries out the prepressing and final pressing operations together and yields a pressed bale (25) having been subjected to final pressing. The additional press (4) may then possibly be eliminated. In another variant, it may be designed as a repress, which only compresses the pressed bale subjected to final pressing, which is inserted or transferred by the transporting device (5) and the bale receptacle (6), to the extent that the bale receptacle (6) can be relieved of the restoring forces and the bale pressure and can be removed from the pressed bale (25). The fixing device (10) and/or packaging device (18) may have the same design as described above.

It is possible in another variant to design the fixing device (10) in a different way in all the above-mentioned exemplary embodiments. It may also be eliminated as an alternative, if, e.g., the packaging means (28) or the bale packaging assumes the fixing of the pressed bale (25) in the pressed form thereof.

The strapping device (10) shown at the transporting device (5), especially at the bale receptacle (6), may be modified in its design. The deflecting means (37) with the one or more strapping channels may be arranged at the support elements (20) or fork tines. The strapping channels may be integrated in the support elements (20) or arranged laterally at the support elements (20), and they are located at some distance from the bale contact side of the support elements (20) in the second case. The push-out device (8) may be adapted correspondingly and may have, e.g., a multipart design with slots for the passage of the strapping bands.

Further, the fixing device (10) may have a different design embodiment and have a different function. As an alternative, or in addition to the plurality of strapping bands (31) shown, one or more other fixing means may be used, e.g., a wide body belt, clamps or the like. The fixing of the pressed bale may be independent from a packaging, especially a wrapping, of the pressed bale (25). The bale fixing described may take place, e.g., prior to the application of a bale wrapping.

Further, the additional press (4) is not absolutely necessary for fixing the pressed bale (25). Fixing may also take place at the bale receptacle (6).

It is possible, besides, to provide a movable construction of the bale receptacle (6) instead of the rigid and fork-shaped bale receptacle (6) shown and preferred, in which case the mutually opposite support elements (20), especially the sets of support elements (20), are movable relative to one another via slides or the like and are adjustable with a suitable controllable drive. The bale receptacle (6) may have, e.g., a split basic carrier (21) with a set of support elements (20) each at the mutually adjustable parts of the basic carrier. A variant with a one-part basic carrier (21) and at least one adjustable set of support elements (20) arranged thereon is also possible. An adjustment may be provided, e.g., for relieving the bale receptacle (6) and for enlarging the feed opening to facilitate pushing out of the preferably fixed pressed bale (25). In the takeover position for removing the bale from the press (3, 3'), the bale receptacle (6) may have a withdrawn configuration, in which it is possibly locked in this position. It now has a rigid form, especially fork shape, and the restoring forces of the pressed bale (25) are absorbed by corresponding guides and preferably positive-locking supports of the adjustable support elements (20) or basic carrier parts. Such a design of the fork makes the arrangement of an additional press (4) possibly dispensable.

The packaging and wrapping technique for the fixed or nonfixed pressed bale (25) may also be modified. The packaging station (19) at an additional press (4) may be eliminated in the exemplary embodiments shown and in the above-mentioned actions. The pressed bale (25), which is possibly fixed at the bale receptacle (6) or the additional press (4), may be fed via a conveyor (24) to a packaging station (19), which is arranged downstream at another location and may have any desired design. This may be, e.g., a hood packaging for stretch films, which widens up a tube or bag with an expandable stretching frame and overturns it over the pressed bale (25), possibly in connection with a gathering means. In addition, any other desired packaging technologies with crossed body belts, wrapping in two or three folded-over films or the like, are possible as well.

Further, the packaging means (28) may also be selected as desired. They may be, e.g., cardboard boxes, crates or the like with relatively rigid walls. In addition, bags or other tube- or web-like packaging materials made of other materials, e.g., textiles, stabilized plastic films or the like, are possible as well.

In addition, in a variant of the exemplary embodiments shown, the packaging technology arranged in the area of the transporting device (5) and possibly at the additional press (4), especially the packaging station (19), may be varied, Instead of the film packaging (32) shown with a plurality of film webs (28), a hood or tube packaging may be used. For example, a film tube open on both sides or a hood open on one side or a bag may also be applied over the pressed bale (25) being held at the bale receptacle (6) with a suitable application means, e.g., the aforementioned displaceable stretching frame with a gathering means that is possibly present. This packaging material may possess elastic elongation properties and cling tightly to the pressed bale (25) after release.

Pressed bales (25) may also be wrapped and packaged airtightly with such or similar packaging technology, in which case a vacuum or reduced pressure is generated in the interior space of the packaging. This may take place due to expansion of the bale and stretching of the wrapping or by drawing off air. The pressed bale (25) is then also fixed by the vacuum or reduced pressure and the higher ambient pressure. A separate fixing means (10) may be eliminated. Such a packaging technology with airtight wrapping and vacuum generation may also be used at another location of the bale press plant and with other, e.g., conventional packaging technology.

FIGS. 27 through 35 as well as 36 through 37 show a packaging technology in which a bale packaging (32) in the form of a tube or hood packaging (28) is applied on a pressed bale (25) by means of an applicator (38). A tube or hood packaging (28) may preferably be manufactured from a tube-shaped film or another suitable tube-shaped packaging material. A hood packaging (28) is essentially bag-shaped. It differs from a tube packaging due to the fact that a hood packaging (28) has a closed side and an open side each, whereas a tube packaging has two open sides.

An applicator (38) may have any desired design. It may have, in particular, shortening means (46). A preferred handling of a tube or hood packaging (28) will be shown below based on the example of a hood packaging (28) closed on one side. A tube packaging with two open sides may be pulled over analogously hereto. The following handling steps are correspondingly analogously applicable to a tube packaging.

Figure 27:
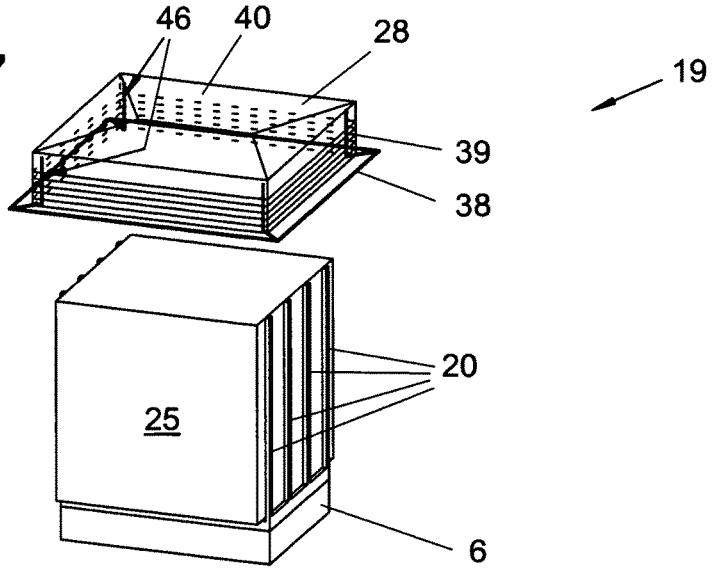
FIG. 27 is a schematic view showing an aspect of the application of a hood packaging to a pressed bale by a pull-over motion.
Figure 28:
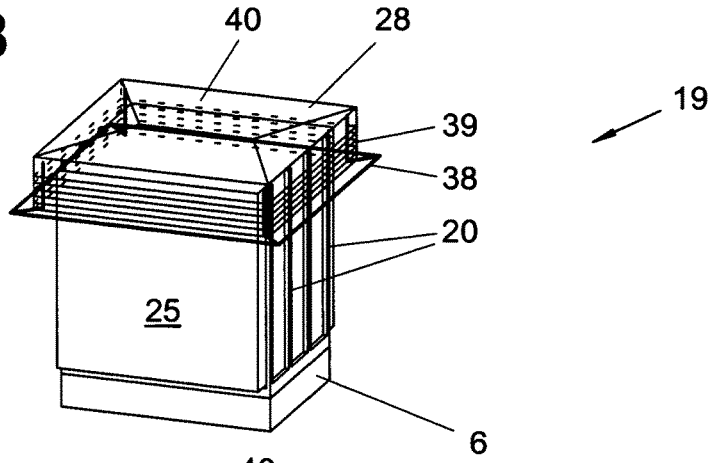
FIG. 28 is a schematic view showing another aspect of the application of the hood packaging to the pressed bale by the pull-over motion.

FIG. 27 shows as an example an applicator (38), at which four shortening means (46) in the form of shortening fingers are arranged. The shortening means (46) are designed to pick up a packaging means (28) in the above-described and controlled manner and then lay it down again. The packaging means (28) preferably has a regular tube shape in the area of the parts to be picked up by gathering. In particular, a circumferential area or tube-shaped wrapping area of the packaging means may be stored on the shortening means (46) in the shortened form. The shortening means (46) may be designed especially to pick up a hood packaging (28) such that the tube-shaped enveloping sides thereof are pulled up as stored packaging means (39) on shortening fingers and a closed side (40) of the hood packaging (28) is stretched between the free ends of the shortening fingers (46).

A hood packaging (28) may be produced, for example, by cutting off a piece of a suitable length from a tube stock provided in a suitable manner and closing it on one side, for example, by welding. This may be preferably carried out by a hood producing device (not shown) at a packaging station (19). The tube stock may be, e.g., in the form of a coil. As an alternative, premanufactured hood packagings may be used.

A hood packaging (28) may be produced at a packaging station (19) preferably in an automated manner from a tube with doubly wrapped sides, which has a double T-shaped cross section. The doubly wrapped tube is pulled off in a flat form from a stock, especially from a coil, and cut off to obtain a piece of a suitable length. One of the tube ends is closed with a straight closing point. The closing point preferably extends at right angles to the direction in which the tube section is pulled off and closes an open end of the tube, possibly in an airtight manner. Such a closing point may be prepared, for example, by welding. As an alternative, any other desired closing technique may be employed.

The closed tube end may form the bottom side of the hood packaging (28). After closing on one side, the tube may be unfolded at its end that is not closed. The unclosed end may correspondingly form the filling side of a hood packaging (28). Unfolding is preferably carried out such that shortening means (46) pick up the four corner points of the tube and pull them apart in a rectangular shape, e.g., at right angles to the direction of wrapping. The hood packaging (28) now opens and forms an open bag shape.

As an alternative, the unfolding of an open tube end may be brought about by a separate opening means. The tube or hood packaging (28) can be transferred by the opening means with the opened side to shortening means (46) of an applicator (38). A premanufactured tube or hood packaging can also be unfolded manually and possibly transferred to the shortening means (46).

The packaging means can be pulled over in the area of its enveloping sides on the shortening means (46) from the opened side (filling side) of the tube or hood packaging (28). The pulling over is preferably carried out by corresponding conveying means at the shortening means (46). These may be, for example, controllably driven friction rollers (not shown). As an alternative, any other desired conveying means may be used.

The tube or hood packaging (28) is pulled over the applicator, especially the shortening means (46), preferably over a controllable length of the tube area. The pulling over is carried out in case of a hood packaging (28) preferably from the filling side to the extent that the closed end (40), which forms a stretched bottom side between the shortening means (46), is reached. The result of a hood packaging (28) pulled over in this manner is shown in FIG. 27. The described production, unfolding and pulling over of a hood packaging (28) may preferably take place fully automatically.

The applicator (38) may be preferably designed as an expandable stretching frame. Such a design is obtained, for example, by a movable arrangement of the shortening means (46) at the applicator (38). Mobility of the shortening means (46) can, in particular, be provided in such a way that these means are displaceable towards the outside essentially in the direction of the diagonal of a frame-shaped pulled-over packaging means (28). As an alternative or in addition, the shortening means (46) may be movable in the direction of the longitudinal sides of a packaging means (28) pulled over in a frame-like manner. By moving the shortening means (46) apart, prestretching of the pulled-over hood packaging (28) can take place in the area of the enveloping sides.

FIG. 27 shows a pressed bale (25), which is held in a bale receptacle (6). The bale receptacle is shown in an exemplary orientation, in which the support elements (20) point upward and the front side of the pressed bale (25), which front side is freely accessible from the outside and is located in the direction of the ends of the support elements (20), thus points upward as well. An applicator (38), over which a hood packaging (28) is pulled, is arranged above the pressed bale. This orientation in space of the bale receptacle (6) and applicator (38) is selected here merely for reasons of greater clarity. As an alternative, any other desired orientation may be selected. The relative orientation of the bale receptacle (6) and applicator (38) should preferably be selected such that the applicator (38) can be moved essentially in parallel to the extension of the support elements (20) over the bale receptacle (6) and the pressed bale (25) being held therein. In other words, the relative orientation of the applicator (38) and bale receptacle (6) is preferably selected such that a pulling-over or overturning motion for applying a tube or hood packaging (28) being held at the applicator (38) takes place essentially in parallel to the course of the support elements (20). The absolute orientation can be correspondingly selected freely.

A hood packaging (28) can be applied on a pressed bale (25), for example, in the manner shown in FIGS. 27 through 35. According to FIGS. 27 through 29, an applicator (38) can be pulled by a relative motion over the bale receptacle (6) and the pressed bale (25) being held therein. In the course of the motion, the hood packaging (28) makes contact first with the closed bottom side (40) with the outwardly freely accessible front side of the pressed bale (25). Packaging means (39) being stored is released from the shortening means (46) during the further motion of the applicator (38) and pulled over the circumferential sides of the pressed bale and the support elements (20), while it forms the enveloping sides of the hood packaging (28).

Figure 29:
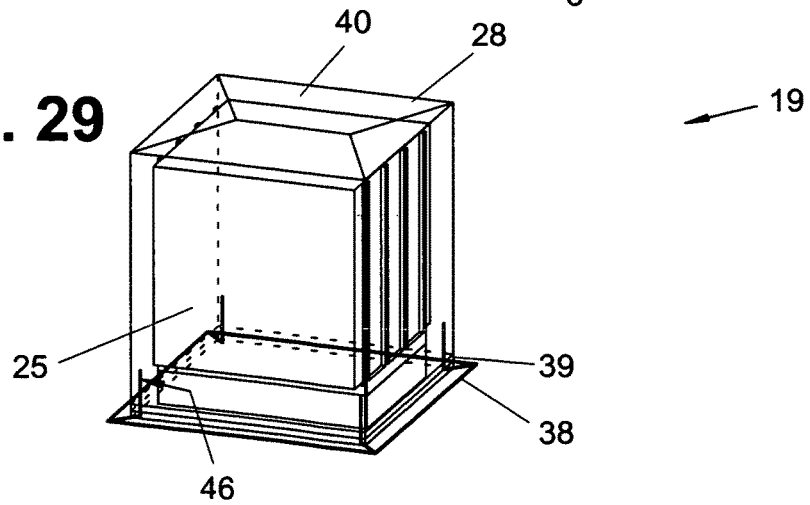
FIG. 29 is a schematic view showing another aspect of the application of the hood packaging to the pressed bale by the pull-over motion.

The pulling-over motion of the applicator (38) over the pressed bale (25) can preferably take place at first to the extent that the enveloping sides of the hood packaging (28) cover the circumferential sides of the pressed bale essentially completely, but a remainder of stored packaging material (39) still remains on the applicator (38). This position is shown in FIG. 29.

The bale receptacle (6) can preferably be separated from the pressed bale (25) in a relative motion, while the hood packaging (28) covers the front side and the circumferential sides of the pressed bale (25). The relative motion can be brought about in different ways. On the one hand, it is possible to remove the pressed bale (25), e.g., by means of a push-out device (8) from the bale receptacle (6). The pulled-over hood packaging (28) may be entrained now due to it being in contact with the front side of the pressed bale (25). As an alternative, or in addition, the pressed bale (25) can be taken up for removal of the bale receptacle (6) between two pressure or holding rams (41). The pressure or holding rams (41) may be designed in the manner of the aforementioned pressure rams (11, 12, 13, 14) of a press and have recesses or recessed channels in the active surfaces, which correspond to the support elements (20). The pressure or holding rams (41) are preferably arranged at the packaging station (19).

Corresponding to the above explanations given for FIGS. 12 through 15 and 24 through 26, the pressed bale (25) can be picked up between pressure or holding rams (41). The course of the packaging means (28) of the hood packaging between the pressed bale (25), support elements (20) and pressure or holding rams (41) can be selected suitably, especially corresponding to FIGS. 24 through 26, depending on the amount of feed of the pressure or holding rams (41), with the pressure or holding rams (41) surrounding the support elements (20). The amount of feed of the pressure or holding rams (41) at the pressed bale (25) can be especially such that the pressed bale is partially or fully released between the support elements (20).

As an alternative, rigidly arranged pressure or holding rams (41) and a bale receptacle (6) with displaceable sets of support elements (20) may be provided. The bale receptacle (6) can be moved in such a case with the hood packaging (28) applied into the area between the pressure or holding rams (41) and then opened. Due to the opening, the support elements (20) can dip into the recesses in the active surfaces of the pressure or holding rams (41), while the pressed bale (25) and optionally the hood packaging (28) expand. The bale receptacle (6) can be optionally opened to the extent that the pressed bale (25) is held by its expanding motion fully between the pressure or holding rams (41).

Figure 30:
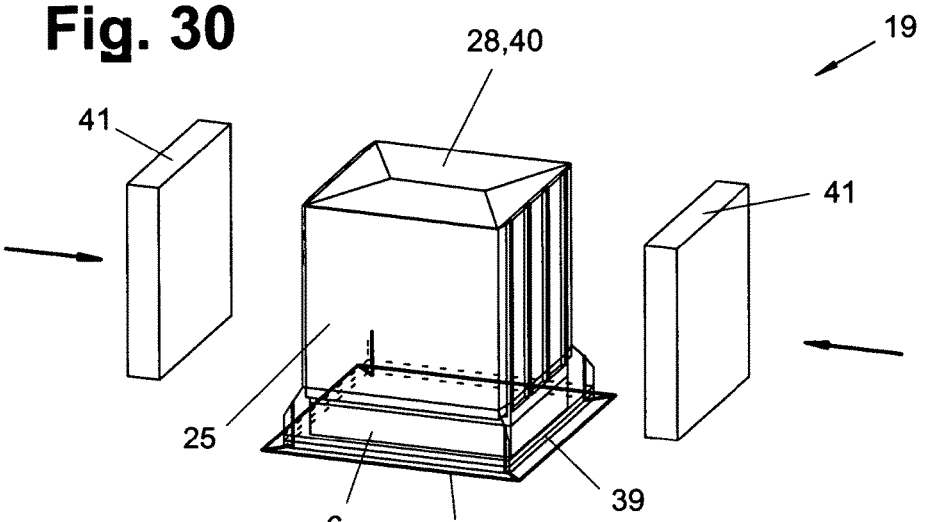
FIG. 30 is a schematic view showing another aspect of the application of the hood packaging to the pressed bale by the pull-over motion.
Figure 31:
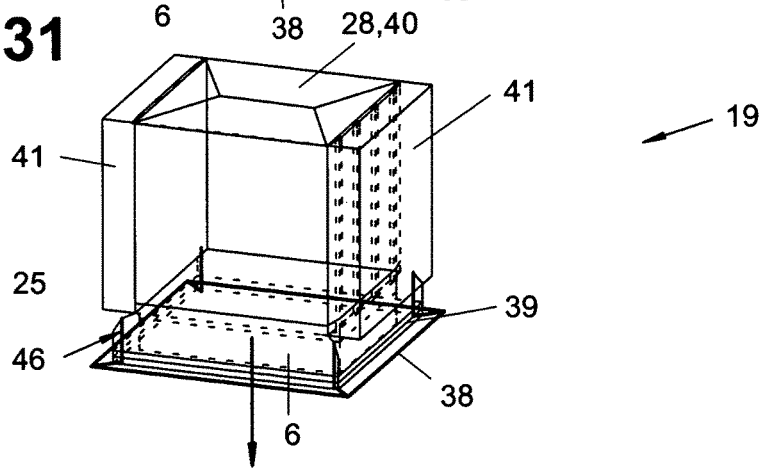
FIG. 31 is a schematic view showing another aspect of the application of the hood packaging to the pressed bale by the pull-over motion.

FIGS. 30 and 31 show a preferred embodiment of a packaging station (19) with pressure or holding rams (41) that can be fed, can be brought into contact with a pressed bale (25) on the side and can fully or partially pick up said pressed bale (25). With the pressure or holding rams (41) brought into contact, the bale receptacle (6) can be pulled out in the direction of the open side (bottom side) of the hood packaging (28), here in the downward direction.

Figure 32:
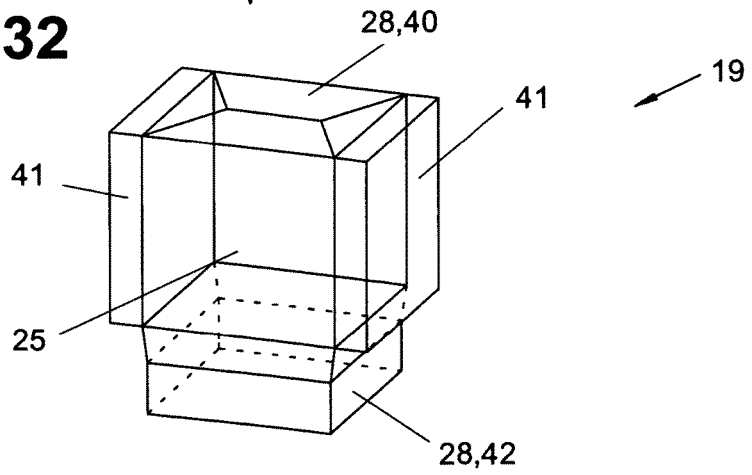
FIG. 32 is a schematic view showing another aspect of the application of the hood packaging to the pressed bale by the pull-over motion.

An excess amount of packaging means (28) can remain held on the applicator (38) during the separation of the bale receptacle (6) from the pressed bale (25) and the hood packaging (28) applied thereon. This excess amount of packaging means (28) may be a tube-shaped area of the packaging means (28), which is preferably selected to be so large that it can be placed, covering, over the still free side of the pressed bale (25). FIG. 32 shows as an example a pressed bale (25) after removal of the bale receptacle (6). The pressed bale (25) is picked up between two pressure or holding rams (41). An excess amount of packaging material (28) forms a half-open tube end (42) on the rear side (here underside) of the pressed bale (25).

Figure 33:
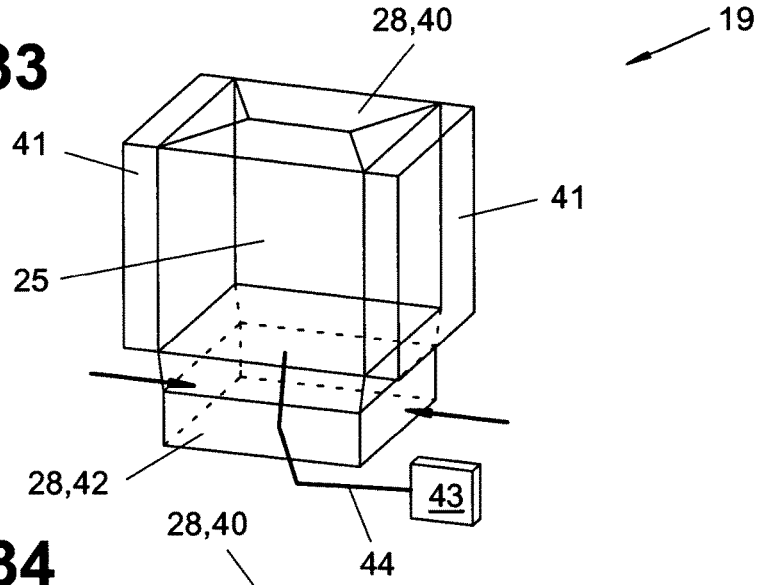
FIG. 33 is a schematic view showing another aspect of the application of the hood packaging to the pressed bale by the pull-over motion.
Figure 34:
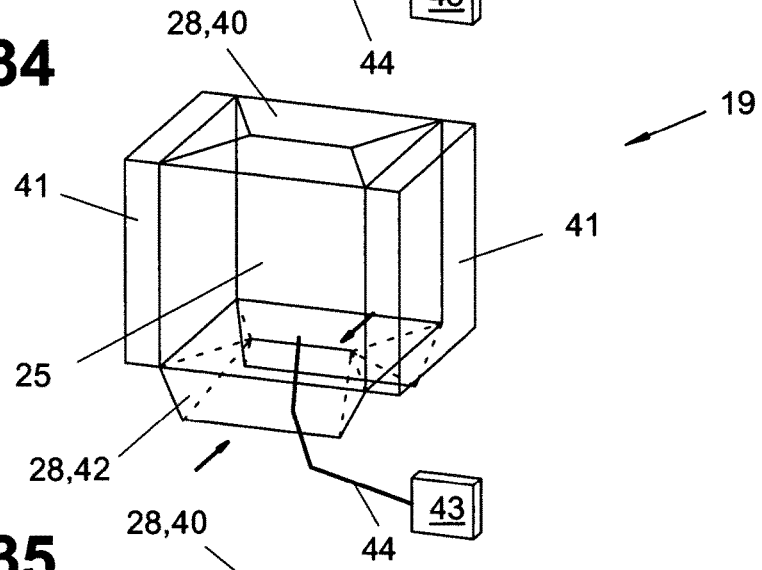
FIG. 34 is a schematic view showing another aspect of the application of the hood packaging to the pressed bale by the pull-over motion.
Figure 35:
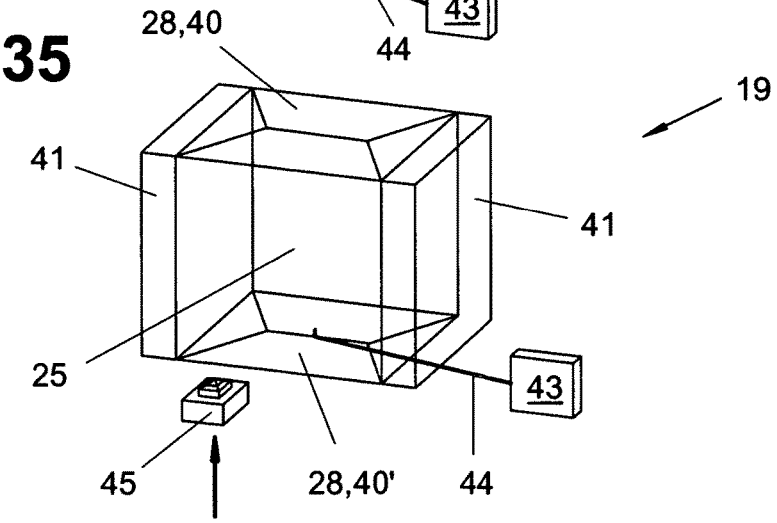
FIG. 35 is a schematic view showing another aspect of the application of the hood packaging to the pressed bale by the pull-over motion.

A packaging station (19) may preferably have means for placing a half-open tube end (42) of a tube or hood packaging (28) applied on the pressed bale over the pressed bale (25). The laying means may have any desired design, for example, they may be designed as a folding device with movable material grippers and folding knives. Different forms of suitable laying means are known in practice. FIGS. 33 through 35 show, for example, a possibility of laying a half-open tube end (42) on the pressed bale (25). Two mutually opposite sides of the half-open tube end (42) can be folded towards the pressed bale (25) (arrows in FIG. 33) in a first step. The other two sides of the half-open tube end (42) can be laid on the pressed bale (25) in a further step, and these sides cover the first two sides. As an alternative, any other desired method may be used to lay the half-open tube end (41).

A tube or hood packaging (28) may preferably sealingly surround a pressed bale (25) on all sides. It may be applied especially with vacuum and form a fixing for the pressed bale. A packaging sealing on all sides can be applied, for example, by means of a tube or hood packaging (28). The tube or hood packaging (28) can be applied on a pressed bale (25) according to the above explanations and the views shown in FIGS. 27 through 32. As an alternative, it may be applied in a different way.

An open tube end (42) of a hood packaging (28) can be preferably placed on the pressed bale (25) and closed in such way that a vacuum is generated in the hood packaging. This is shown as an example in FIGS. 33 through 35. The vacuum may be generated in any desired manner. A suction means (43), which generates a reduced pressure or a vacuum within the packaging (28) by means of a suction pipe (44) during the laying of the half-open tube end (42) on the pressed bale (25), may be preferably provided. The pipe may also be inserted, for example, into the overlapping sides of the laid packaging (28). The sides applied can be closed by a suitable device in the laid-down position, for example, by a welding means (45).

As an alternative, a half-open tube end (42) can be first closed and then placed on the pressed bale, while vacuum is generated in the packaging (28). A tube or hood packaging (28) may have for this purpose, for example, a valve, via which a reduced pressure or vacuum is generated in the packaging (28) by means of a suction means (43). The half-open tube end (42) may be closed in any desired manner. It may be closed especially by a welding means (45). The at first half-open and then closed tube end (42) can also be placed simply by generating the reduced pressure in the packaging (28), without controlled placement being provided.

In a variant of the application of a hood packaging (28) shown in FIGS. 27 through 35, a tube packaging open on both sides can be pulled alternatively over a pressed bale (25) by means of an applicator (38). After removing the bale receptacle (6), the two half-open tube ends (42) can then be closed and possibly laid on the pressed bale (25), while a reduced pressure is optionally generated in the packaging (28).

Figure 36:
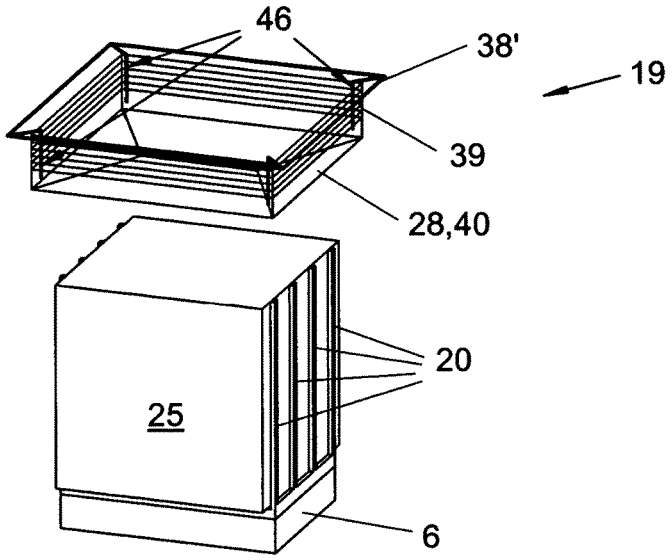
FIG. 36 is a schematic view showing the application of a hood packaging to a pressed bale by an overturning motion.
Figure 37:
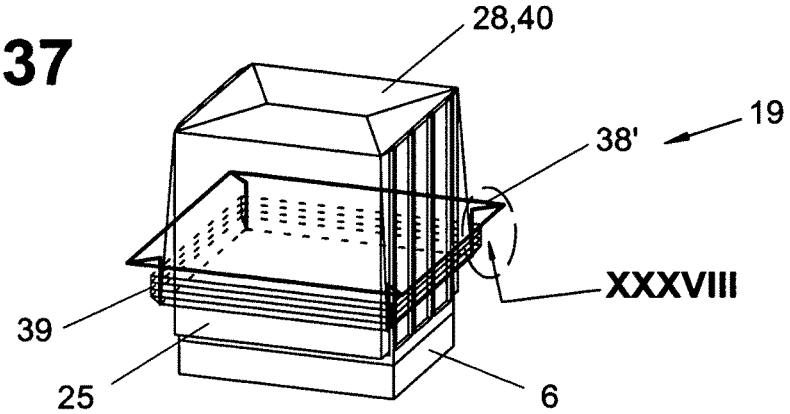
FIG. 37 is a schematic view showing the application of the hood packaging to the pressed bale by the overturning motion.

A hood packaging (28) may be preferably applied on a pressed bale (25) by a pulling-over or overturning motion. The shortening means (46) at the applicator (38), especially the shortening fingers (46), can be arranged such that they point away from the bale receptacle (6) and the pressed bale (25). This is shown in FIGS. 27 through 31. The applicator (38) is preferably designed in this configuration to perform a pulling-over motion. As an alternative, the shortening means (46) may be arranged at the applicator (38), especially the shortening fingers, such that they point to the bale receptacle (6) and to the pressed bale (25), as is shown, for example, in FIGS. 36 and 37.

Figure 38:
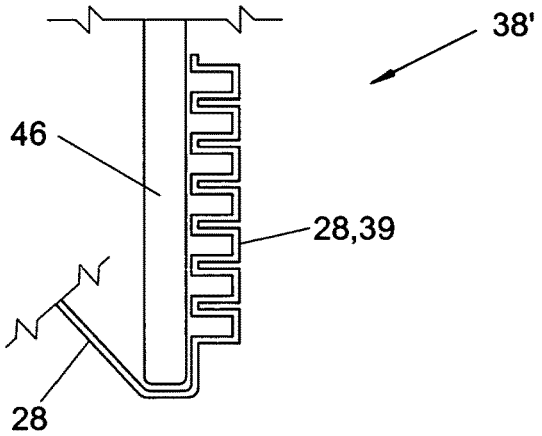
FIG. 38 is a detail view of gathered packaging means on an applicator according to arrow XXXVIII in FIG. 37.

The packaging means (39) being stored on the shortening means (46) is running off essentially in a straight line with a pull-off angle of 0° to 90° during a pulling-over motion. The pull-off angle is the angle that is formed between an imaginary extension of the shortening means (46) and the actual course of the stretched film material during the transfer of the latter to the circumferential sides of the pressed bale (25). The packaging means (39) being stored runs, by contrast, around the ends of the shortening means (46) in an arc-shaped pattern during an overturning motion, and a pull-off angle between 90° and 180° is formed. The material of the hood packaging (28) is turned from the inside to the outside during an overturning motion. The side of the hood packaging (28) that has pointed outwardly on the applicator (38) forms the inside in the position in which it is applied on the pressed bale and vice versa. FIG. 38 shows the running of the packaging means (28) around a shortening means (46) during an overturning motion in an enlarged view.

The use of a pulling-over or overturning motion may have various advantages. A hood packaging (28) can be applied during a pulling-over motion on the side of the applicator that faces away from the pressed bale. The charging of the applicator (38) with a new tube or hood packaging can thus take place separately in space from the application to a pressed bale. An applicator (38) can already be charged with a new tube or hood packaging (28) in this manner while a pressed bale (25) is still located in the packaging station (19), so that the packaging station (19) can have an especially short work cycle.

A specially controlled application of the tube or hood packaging (28) to the pressed bale can take place during an overturning motion. In particular, the packaging means (28) can be released in the area of the shortening means (46) with a controlled tension. The tube or hood packaging (28) can thus also be applied in the direction of the application motion with an elastic prestretching.

A tube or hood packaging (28) may also be able to be applied to a pressed bale (25) at a packaging device (18). For example, a modified packaging means (18) may be provided with an applicator (38) for applying a tube or hood packaging at a press (3, 4) in a variant of the exemplary embodiment shown in FIGS. 11 through 18. The application of a tube or hood packaging (28) may take place analogously to the above explanations via a packaging station and analogously to FIGS. 27 through 37. The applicator (38) may be displaceable, for example, in the horizontal direction and able to be displaced between the pressure rams (13, 14) of a finishing press (4).

Figure 11:
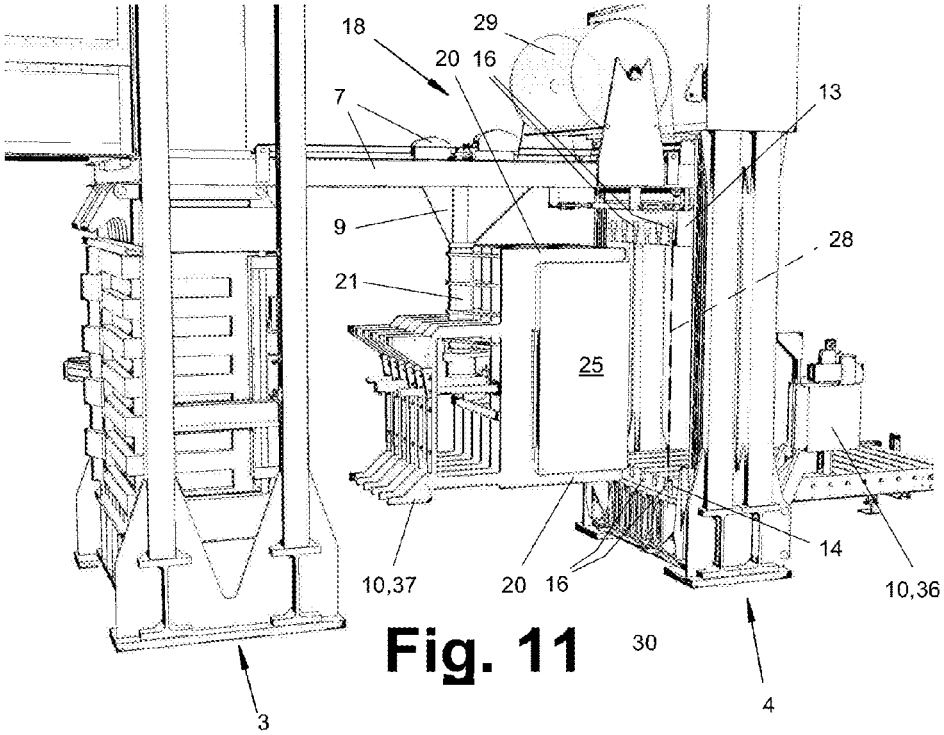
FIG. 11 is an exemplary perspective view showing another aspect of a work process of a bale press plant according to FIG. 1 with a transporting device and a packaging device.
Figure 12:
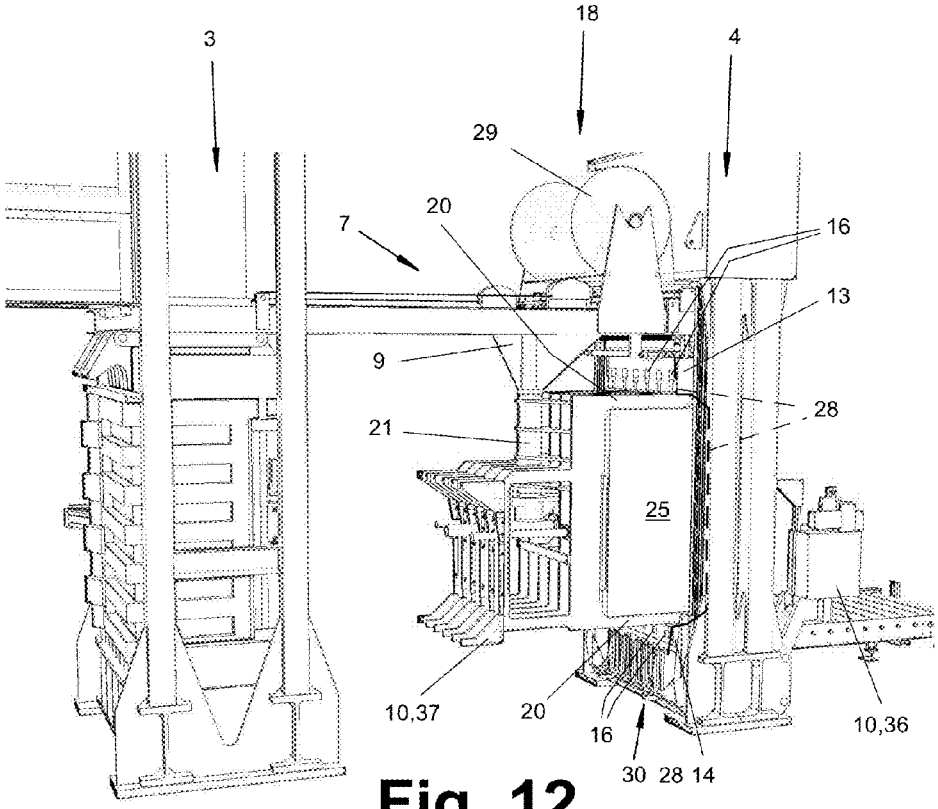
FIG. 12 is an exemplary perspective view showing another aspect of a work process of a bale press plant according to FIG. 1 with a transporting device and a packaging device.

For example, a packaging technology in which a bale receptacle (6) is inserted at first into a press (4) with a pressed bale (25) being held therein analogously to FIGS. 11 and 12 may be carried out on a packaging device (18) thus modified. An applicator can then apply a tube or hood packaging (28) over the pressed bale (25) and the bale receptacle (6) from the push-out side of the press (4). The pressure rams (13, 14) can then optionally be closed somewhat and brought into contact with the pressed bale (25), and the pressure rams (13, 14) surround the support elements (20). The pressed bale (25) can be picked up and held partially or completely in the press (4) in this manner.

The bale receptacle (6) may be separated from the pressed bale (25) optionally while actuating a push-out device (8) at the same time and moved out of the tube or hood packaging applied.

One half-open tube end (42) or both half-open tube ends (42) of the tube or hood packaging (28) may be subsequently closed and optionally placed on the pressed bale (25).

If the pressed bale (25) shall be subjected to yet another pressing operation, the pressure rams (13, 14) can optionally compress the pressed bale (25) enveloped in the tube or hood packaging further after removal of the bale receptacle (6). This can take place while the tube ends are still open or are already closed. In particular, final pressing can take place simultaneously with the closure and optionally the placement of the tube ends.

The tube or hood packaging (28) closed on both sides can be preferably applied with reduced pressure. The reduced pressure may be generated in any desired manner. In particular, a suction means (35) may be provided at the modified packaging device (18). The suction means can enter an open tube end of the tube or hood packaging (28), for example, via a suction pipe corresponding to the above explanations and generate a reduced pressure in the packaging (28) before or during closure. As an alternative, a valve may be provided in the tube or hood packaging (28).

The pressed bale (25) may be preferably fixed by the reduced pressure in the tube or hood packaging (28). As an alternative or in addition, a fixing means, especially a one-part or multipart strapping (31), may be applied on the pressed bale (25). The fixing means may be applied on the tube or hood packaging (28) especially on the outside, so that contamination of or damage to the pressed bale (25) due to the fixing means is prevented from occurring. A fixing means may be applied especially by means of a strapping device according to one of the aforementioned exemplary embodiments.

The present invention is not limited to the exemplary embodiments shown and described. The features shown and described may be combined, interchanged or omitted as desired. In particular, a bale press plant (1) may be provided with a transporting device (5) of the type described, but without a packaging system (18) or packaging station (19). A packaging system (18) may likewise be arranged independently from an additional press (4), especially a finishing press. All features of a packaging stations (19) may be extrapolated to a packaging device (18) in a corresponding manner and vice versa. The transporting device (5) may also be designed independently from a bale press (2) and pick up, for example, strapped pressed bales, in which case the strapping is opened within a bale receptacle (60, so that the compressed pressed bale is relaxed in the direction of the support elements (20) in a controlled manner. The pressed bale (256) can thus be secured against uncontrolled expansion.

The feed of packaging material (28), especially film material or tube material, to a packaging system (18) or to a packaging station (19) may be designed as desired. For example, a stock may hold one or more packaging materials, tube or film sections already cut into a length. As an alternative, a film curtain may be applied manually or in an only partly automated manner. The means (30) for stretching a film web (28) may be, for example, statically or movably arranged film holders in this case.

Strapping (31) may also be applied manually or in a partly automated manner. A strapping apparatus (37) may be operated, for example, manually and cooperate with an adjustable deflecting means (36). The plurality of strapping bands of a strapping (31) may be placed as a group and, e.g., simultaneously or one by one, one after another, and optionally also be gathered.

While specific embodiments of the invention have been shown and described in detail to illustrate the application of the principles of the invention, it will be understood that the invention may be embodied otherwise without departing from such principles.

The invention claimed is:

1. A packaging system, which is designed to apply a bale packaging on a compressed pressed bale, the packaging system comprising:

a bale press;

a transporting device to remove a compressed pressed bale from the bale press, the transporting device comprising:

a movable bale receptacle for picking up a compressed pressed bale on two opposite sides, wherein the bale receptacle has a plurality of elongated support elements located at spaced locations from one another in areas provided for retaining the pressed bale, wherein the support elements are rigidly arranged, as an upper set of support elements and a lower set of support elements, on a basic carrier of the bale receptacle; and a moving device comprising a multiaxial manipulator for moving the bale receptacle, wherein the basic carrier of the bale receptacle is connected with the multiaxial manipulator; and an additional bale press for compressing the pressed bale being held in the bale receptacle, the additional bale press comprising pressure rams comprising recesses, wherein the support elements are spaced apart from each other by a distance that is the same as a spacing distance between the recesses of the pressure rams of the additional bale press.

2. A packaging system in accordance with claim 1, further comprising an applicator for applying a tube or hood packaging to a pressed bale being held in the bale receptacle, wherein the applicator is operatively arranged between the press and the additional press or is operatively arranged at the additional press.

3. A packaging system in accordance with claim 1, wherein the transporting device further comprises a fixing device for fixing the pressed bale.

4. A packaging system in accordance with claim 1, wherein the bale receptacle is driveable and positionable by rotatory motion about a vertical axis.

5. A packaging system in accordance with claim 1, wherein:

the bale receptacle is driveable and positionable by translatory motion along a vertical axis.

6. A packaging system in accordance with claim 1, wherein the bale receptacle is driveable and positionable by translatory motion along a horizontal axis.

7. A packaging system in accordance with claim 1, wherein the bale receptacle is driven and positioned by rotatory motion about a horizontal axis.

8. A packaging system in accordance with claim 1, wherein the bale press comprises a pressure ram with an active surface having recesses wherein the arrangement of the support elements corresponds to the recesses in the active surface of the pressure ram and the bale receptacle is designed as a supporting fork.

9. A packaging system in accordance with claim 1, wherein sliding edges are arranged at the free ends of the support elements to facilitate a sliding around of a packaging film.

10. A packaging system in accordance with claim 1, wherein:

the bale receptacle with the pressed bale being held therein is moveable through a stretched film web;

the film web is feedable at at least one end and forms a loop around the bale receptacle and the pressed bale; and the support elements are designed to pick up the pressed bale, which is under pressure, at the press, while the pressed bale is being held between the support elements due to its elastic internal stress.

11. A packaging system in accordance with claim 1, wherein a pressed bale is retainable within a film loop by a push-out device, while pulling out the bale receptacle.

12. A packaging system in accordance with claim 1, further comprising a closing device closing a tube or hood packaging pulled over a pressed bale at an open tube end.

13. A packaging system in accordance with claim 1, further comprising an applicator transferring a tube or hood packaging to a pressed bale with a pulling-over motion, wherein the applicator transfers the tube or hood packaging to the pressed bale with an overturning motion.

14. A bale press plant comprising:

a first bale press for forming and compressing pressed bales, the first bale press comprising pressure rams with recesses;

a packaging device comprising a transporting device to remove a compressed pressed bale from the first press, the transporting device having a movable bale receptacle for picking up the compressed pressed bale on two opposite sides, wherein the bale receptacle has a plurality of elongated support elements located at spaced locations from one another in areas provided for retaining the pressed bale and the support elements are rigidly arranged, as an upper set of support elements and a lower set of support elements, on a basic carrier of the bale receptacle, and wherein the support elements are spaced apart by a distance that essentially corresponds to a spacing between recesses of the pressure rams of the first press; and a second bale press comprising second bale press pressure rams with recesses, wherein the spacing between support elements also essentially corresponds to a spacing between recesses of the second bale press pressure rams.

15. A bale press plant in accordance with claim 14, further comprising an applicator for applying tube packaging or hood packaging to a prepressed or pressed bale while the bale is held in the bale receptacle.

16. A bale press plant in accordance with claim 14, wherein:

the first bale press comprises a prepress and the second bale press comprises a finishing press;

the transporting device removes a compressed pressed bale from a press;

the bale receptacle is insertable for enclosing a compressed pressed bale with support elements in recesses of pressure rams of the press;

the transporting device deposits a compressed pressed bale in a finishing press, wherein the bale receptacle is insertable between opened pressure rams of the finishing press.

17. A bale press plant in accordance with claim 14, wherein the pressure rams of the second press take over a compressed pressed bale from the bale receptacle, wherein the recesses in active surfaces of the pressure rams extend around the support elements of the bale receptacle.

18. A method for applying a bale packaging on a compressed pressed bale, the method comprising the steps of:

providing a packaging system comprising a transporting device to remove a compressed pressed bale from a press, the transporting device having a movable bale receptacle for picking up a compressed pressed bale on two opposite sides, wherein the bale receptacle has a plurality of elongated support elements located at spaced locations from one another in the areas provided for retaining the pressed bale;

picking up a compressed pressed bale with the movable bale receptacle of the transporting device at the press and subsequently packaging the compressed pressed bale, wherein the bale receptacle grasps the pressed bale in the press on two opposite sides with the plurality of elongated support elements each, which are located at spaced locations from one another wherein:

a tube or hood packaging is applied on the compressed pressed bale while the compressed pressed bale is held in the bale receptacle; and the pressed bale is inserted into a finishing press, and the pressed bale, with applied tube or hood packaging, is subjected to final compression at the finishing press.

19. A method in accordance with claim 18, wherein the pressed bale is provided with a fixing means for fixing the bale and the fixing means is applied on an outside of the tube or hood packaging.

20. A method in accordance with claim 18, wherein the pressed bale is inserted into the finishing press together with the tube or hood packaging by movement of the bale receptacle; and the pressure rams of the finishing press compress the pressed bale enveloped in the tube or hood packaging further after removal of the bale receptacle.

* * * * *